US011668210B2

(12) United States Patent
Kamble et al.

(10) Patent No.: US 11,668,210 B2
(45) Date of Patent: Jun. 6, 2023

(54) SYSTEMS AND METHODS FOR ROCKER ARM LUBRICATION

(71) Applicant: Powerhouse Engine Solutions Switzerland IP Holding GmbH, Zug. (CH)

(72) Inventors: Sandeep Namadev Kamble, Bangalore (IN); John Patrick Dowell, Grove City, PA (US); Samir Vikas Joshi, Bangalore (IN)

(73) Assignee: Powerhouse Engine Solutions Switzerland IP Holding GmbH, Zug (CH)

( * ) Notice: Subject to any disclaimer, the term of this patent is extended or adjusted under 35 U.S.C. 154(b) by 0 days.

(21) Appl. No.: 17/021,924

(22) Filed: Sep. 15, 2020

(65) Prior Publication Data

US 2022/0018270 A1 Jan. 20, 2022

(30) Foreign Application Priority Data

Jul. 14, 2020 (IN) ..... 202041029921

(51) Int. Cl.

| | |
|---|---|
| ***F01L 1/18*** | (2006.01) |
| ***F01M 9/10*** | (2006.01) |
| ***F01L 1/047*** | (2006.01) |
| ***F01L 1/14*** | (2006.01) |

(52) U.S. Cl.

CPC ..... *F01L 1/181* (2013.01); *F01L 1/047* (2013.01); *F01L 1/146* (2013.01); *F01M 9/10* (2013.01); *F01L 2810/02* (2013.01)

(58) Field of Classification Search

CPC ... F01L 1/181; F01L 1/18; F01L 1/185; F01L 2810/02; F01L 1/146; F01L 1/047; F01M 9/10; F01M 9/107; F01M 11/02; F02B 2275/34

USPC ..... 123/90.39, 90.36, 196 R, 90.33; 184/6.9

See application file for complete search history.

(56) References Cited

U.S. PATENT DOCUMENTS 2,725,955 A * 12/1955 Roos ..... F01M 9/102 184/6.9
4,343,270 A * 8/1982 Kawabe ..... F01L 1/053 123/196 V
4,655,177 A 4/1987 Wells et al.
5,394,842 A 3/1995 Kobayashi
(Continued)

FOREIGN PATENT DOCUMENTS

CN 102926829 A 2/2013
DE 102005016190 A1 * 9/2006 ..... F01M 9/10
(Continued)

OTHER PUBLICATIONS

Kamble, S et al., "Systems and Methods for Rocker Arm Lubrication," U.S. Appl. No. 17/021,910, filed Sep. 15, 2020, 43 pages.
(Continued)

*Primary Examiner* — Kenneth J Hansen
*Assistant Examiner* — Wesley G Harris
(74) *Attorney, Agent, or Firm* — McCoy Russell LLP

(57) ABSTRACT

Systems and methods for intermittent supply of lubricating oil to a tip of a rocker arm assembly. In one embodiment, a lubricating oil may be selectively to a tip of a rocker arm via oil channels aligned only during opening of a valve coupled to the tip.

9 Claims, 13 Drawing Sheets

(56) References Cited

U.S. PATENT DOCUMENTS

| | | | | |
|---|---|---|---|---|
| 5,553,583 | A * | 9/1996 | Jones | F01L 1/181 123/90.34 |
| 6,230,676 | B1 | 5/2001 | Pryba et al. | |
| 2009/0205600 | A1* | 8/2009 | Vogel | F01L 1/181 123/90.39 |

FOREIGN PATENT DOCUMENTS

| | | | | |
|---|---|---|---|---|
| JP | H07279637 | A | | 10/1995 |
| JP | 2004060456 | A | * | 2/2004 |
| RU | 2410548 | C2 | | 1/2011 |
| WO | 0118373 | A1 | | 3/2001 |

OTHER PUBLICATIONS

Eurasian Patent Office, Search Report Issued in Application No. 202092401, dated Feb. 18, 2022, 5 pages.
Eurasian Patent Office, Search Report Issued in Application No. 202092402, dated Feb. 18, 2022, 4 pages.

* cited by examiner

SYSTEMS AND METHODS FOR ROCKER ARM LUBRICATION

CROSS REFERENCE TO RELATED APPLICATION

The present application claims priority to Indian Patent Application No. 202041029921, entitled "SYSTEMS AND METHODS FOR ROCKER ARM LUBRICATION", and filed on Jul. 14, 2020. The entire contents of the above-listed application is hereby incorporated by reference for all purposes.

BACKGROUND

Technical Field

Embodiments of the subject matter disclosed herein relate to intermittently supplying lubricating oil to a tip of a rocker arm of a locomotive engine.

Discussion of Art

Internal combustion engine systems such as in a locomotive engine, rocker arm assemblies are used for actuation of cylinder valves. During operation of the engine, components of the rocker arm assembly is supplied with a lubricating oil to facilitate relative movement of the rocker arm components. Lubricating oil may be supplied from a cylinder head to a rocker arm assembly via channels in a rocker pedestal supporting components of one or more rocker arm assemblies. After lubricating the rocker arm assembly, the excess oil may be drained from components of the rocker arm assembly such as a valve stem.

A constant supply of lubricating oil to a rocker arm tip over an engine cycle, oil may flood the valve system coupled to the tip. Oil supplied to a valve system when the valve is not being actuated may cause oil stagnation and stagnated oil may not be effectively drained from the valve system. Also, by concurrently dividing the total supplied oil between both cylinder valves, a lower amount of oil may be supplied to the valve being actuated, thereby reducing the amount of oil being supplied moving components of the rocker arm assemblies. It may be desirable to have a system and method that differs from those that are currently available.

BRIEF DESCRIPTION

In one embodiment, a method for an engine may include selectively supplying lubricating oil to a tip of a rocker arm via oil channels aligned only during opening of a valve coupled to the tip.

In another embodiment, a method for an engine may include, upon aligning of oil channels only during opening of a valve coupled to a tip of a rocker arm, selectively splashing lubricating oil to a cover of the rocker arm and supplying the splashed lubricating oil to the tip of the rocker arm.

BRIEF DESCRIPTION OF THE FIGURES

FIGS. 3-6D and 9A-9D are shown to scale, although other relative dimensions may be used, if desired.

DETAILED DESCRIPTION

Figure 1:
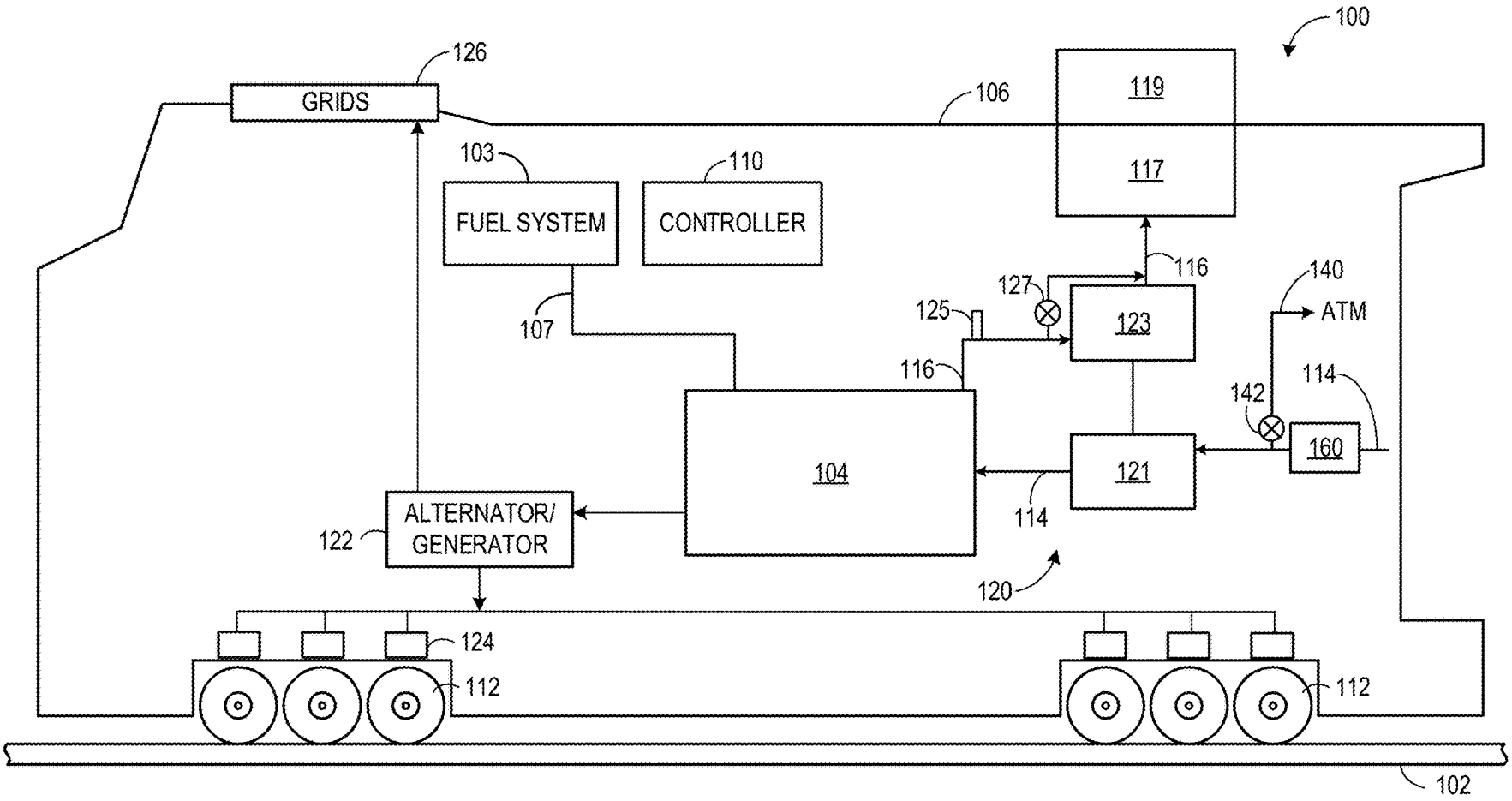
FIG. 1 shows a schematic diagram of a vehicle including an internal combustion engine, according to an embodiment of the invention.

The following description relates to embodiments of a system for intermittently supplying lubricating oil to a tip of a rocker arm of an internal combustion engine.

In one embodiment, a cylinder may be coupled to two rocker arm assemblies with one coupled to the intake valve and another coupled to an exhaust valve. During engine operation, lubricating oil may be delivered from a cylinder head to a tip of a rocker arm via a vertical via oil channels formed in a rocker pedestal supporting the rocker shaft coupled to one or more rocker arms. The oil may be constantly supplied to each rocker arm tip throughout an engine cycle even if the valve coupled to the rocker arm tip is not being operated at the time.

In one example, a method for an engine may include selectively supplying lubricating oil to a tip of a rocker arm via oil channels aligned only during opening of a valve coupled to the tip. In this way, by intermittently supplying oil to the rocker arm tip that is being actuated to open a valve, undesired oil supply to a closed valve may be reduced.

In a first embodiment, in the engine, oil may travel from an oil sump at a cylinder head to a rocker arm via a first, vertical channel on a rocker pedestal supporting one or more rocker arms. The first channel may terminate at the center of a rocker shaft about which one or more rocker arms rock. The oil may then travel via a second, horizontal channel passing through the central axis of the rocker shaft. At locations along the rocker shaft where a bush bearing of a rocker arm surrounds the inner wall of the rocker shaft, a third, vertical oil channel originating from the second, horizontal channel may carry oil to a fourth, horizontal channel passing through a central axis of the rocker arm via a supply groove. The fourth, horizontal channel may fluidically couple the supply groove to a tip of the rocker arm. When the valve coupled to the rocker arm is closed, the supply groove may be offset with the third, vertical oil channel such that oil may not flow to the rocker arm tip and instead may flow to the bush bearing via draining channels. When the rocker arm is tilted during opening of the valve coupled to it, the supply groove may align with the third, vertical oil channel enabling oil to flow from the second, horizontal channel to the rocker arm tip via the third, vertical oil channel and the supply groove.

As another example, in a second embodiment, oil may travel from an oil sump at a cylinder head to a rocker arm via the first, vertical channel on a rocker pedestal supporting one or more rocker arms. The first channel may terminate at the center of a rocker shaft about which one or more rocker arms rock. The oil may then travel via the second, horizontal channel passing through the central axis of the rocker shaft. At locations along the rocker shaft where a bush bearing of a rocker arm surrounds the inner wall of the rocker shaft, a third, vertical oil channel originating from the second, horizontal channel may carry oil to a supply groove. When the valve coupled to the rocker arm is closed, the supply groove may be offset with the third, vertical oil channel such that oil may not be splashed out of the supply groove and instead may flow to the bush bearing via draining channels. When the rocker arm is tilted during opening of the valve coupled to it, the supply groove may align with the third, vertical oil channel enabling oil to flow from the second, horizontal channel to the supply groove. Oil from the supply groove may be splashed upwards towards a cover of the rocker arm. The cover may be equipped with features such as protrusions and slopes that allow oil impinging on the cover to drip back to the rocker arm tip.

In this way, by selectively supplying oil to a tip of a rocker arm only when the valve coupled to the tip is being opened, oil supply to the open valve may be increased facilitating availability of sufficient amount of oil to moving components during opening of the valve. The technical effect of the intermittent oil supply to the valve being actuated is that flooding of the valve systems may be reduced. By reducing stagnation of oil in components of the rocker arm assembly, active draining of oil may be reduced. Further, by supping oil to the bush bearing, friction between adjacent metallic surfaces may be reduced, thereby reducing wear of interface. Overall, a lower volume of lubricating oil as desired for operation of the rocker arm assembly may flow through the cylinder head without the need for drainage of excess oil.

Engine systems according to embodiments of the invention may be suitable for use in mobile applications and stationary applications. Suitable stationary applications may include stationary power generation applications. Suitable mobile applications may include vehicles, such as may be used in the rail, mining, marine, aviation, trucking, and related industrial markets. A locomotive that is configured for the rail market is used herein for illustration purposes. The rail market may include mainline freight haulage, passenger rail, switchers, shunters, and the like.

Figure 2:
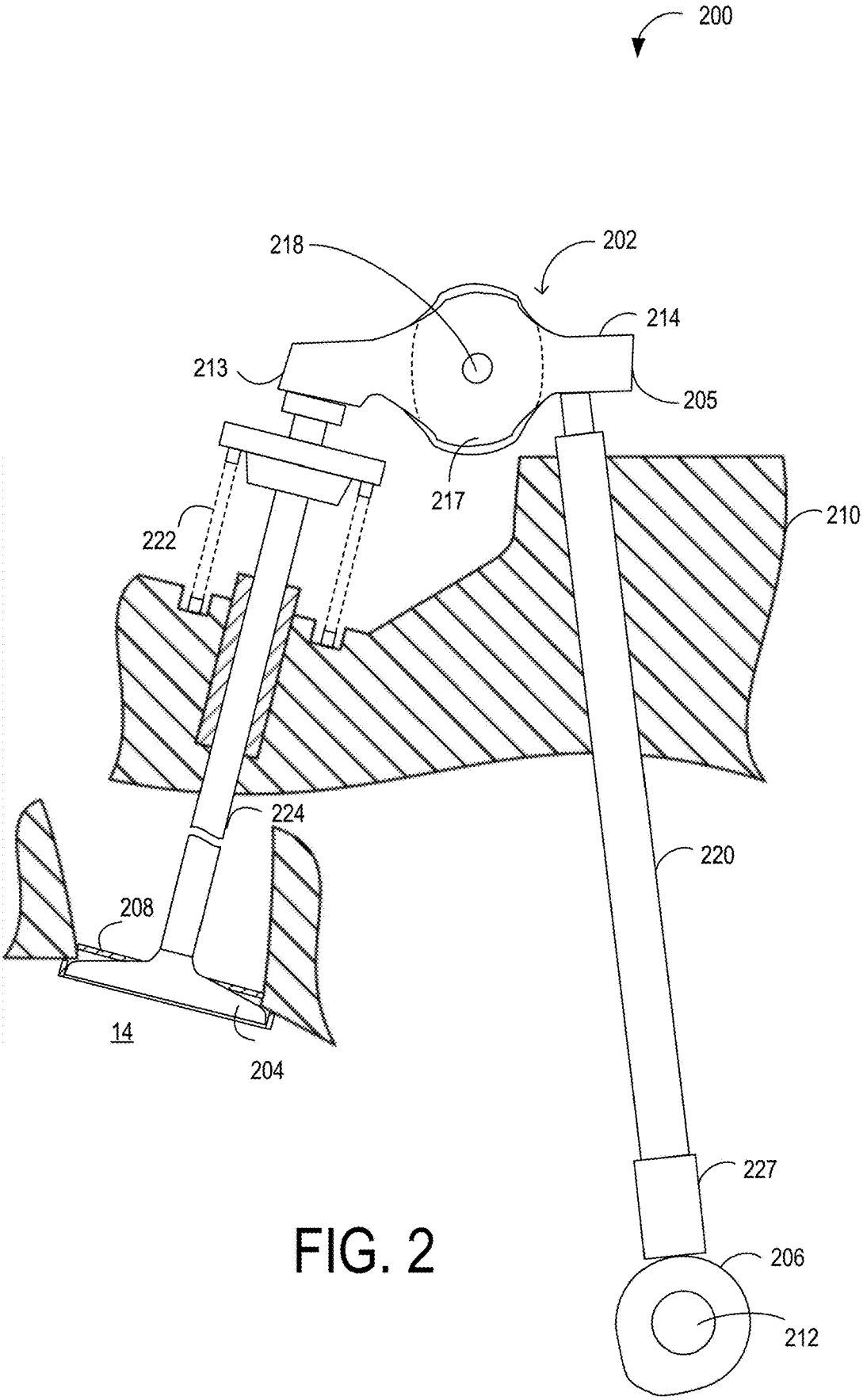
FIG. 2 shows a cross-section of a rocker arm assembly in the internal combustion engine of FIG. 1.
Figure 3:
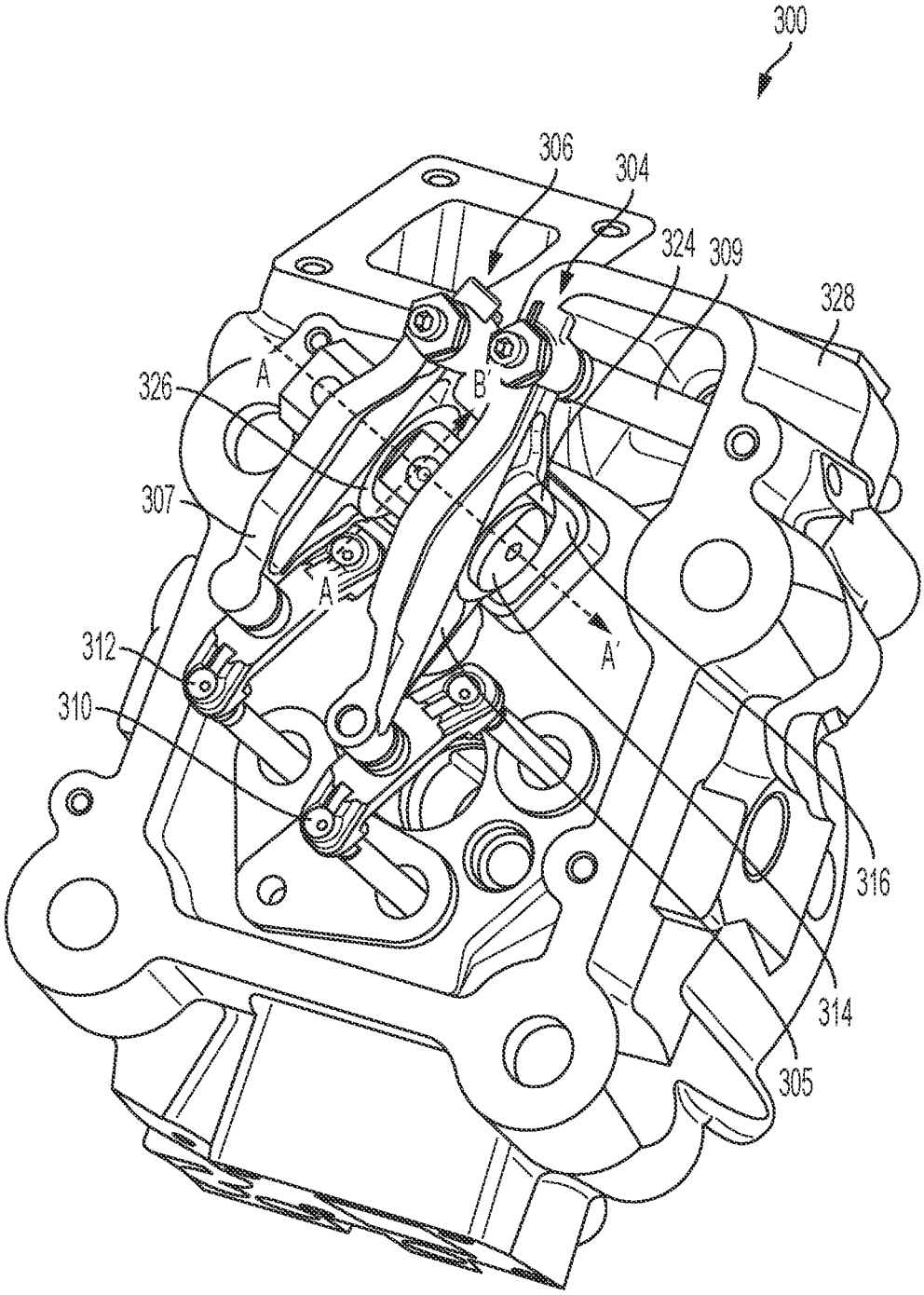
FIG. 3 shows an arrangement of rocker arm assemblies including a rocker shaft.
Figure 4:
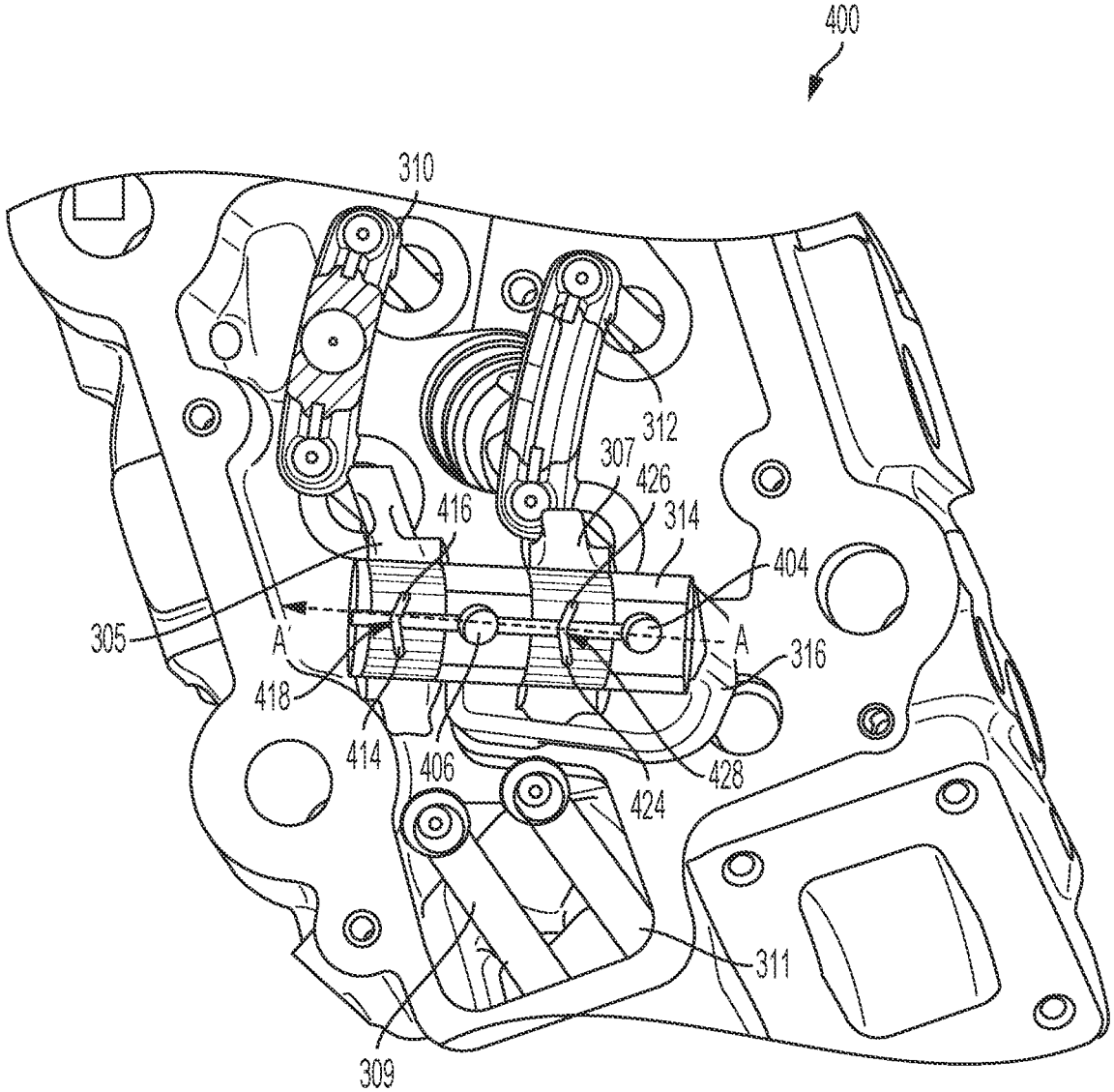
FIG. 4 shows a cross-section of the rocker shaft including oil channels.
Figure 5:
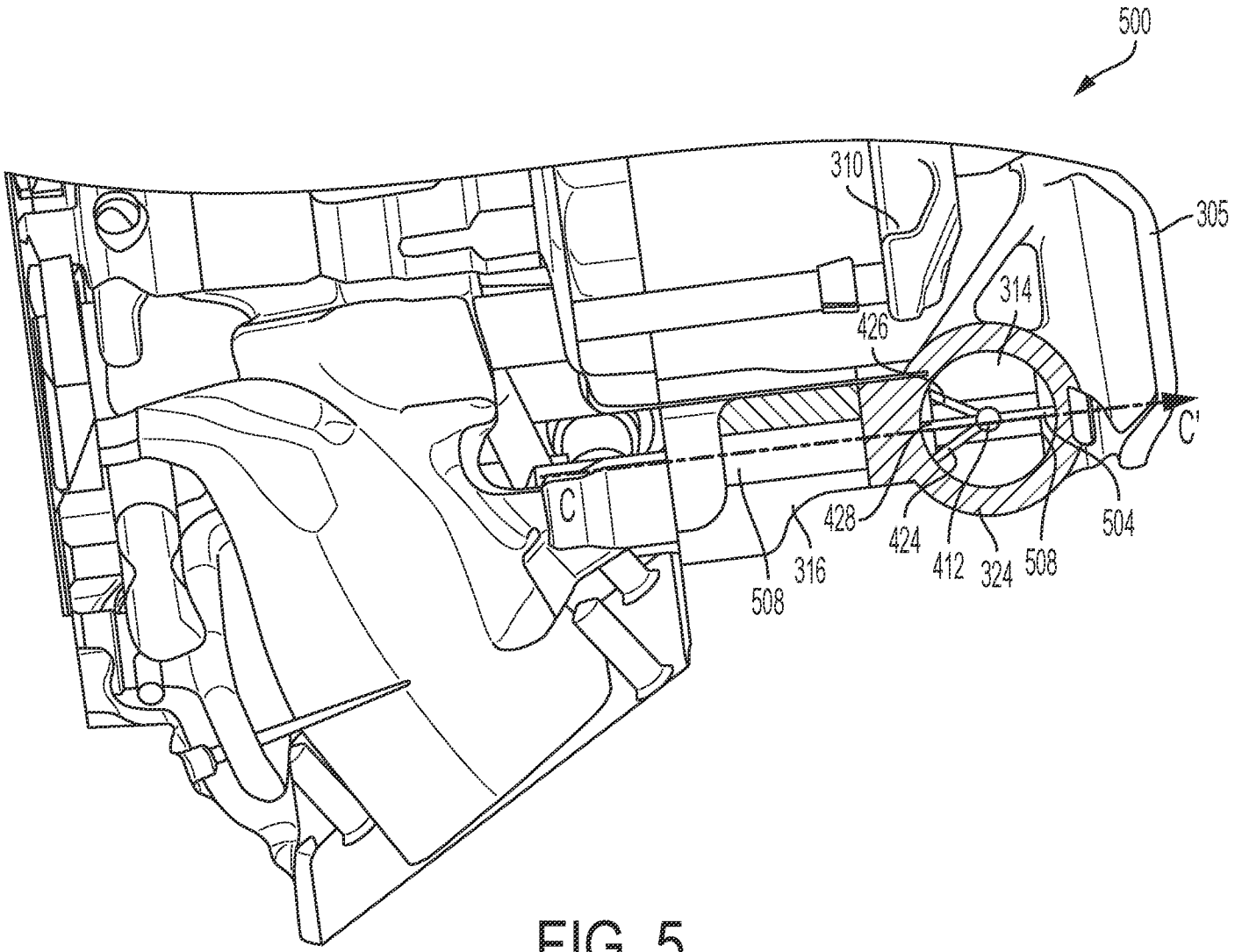
FIG. 5 shows a cross-section of a rocker pedestal including oil channels.
Figure 6A:
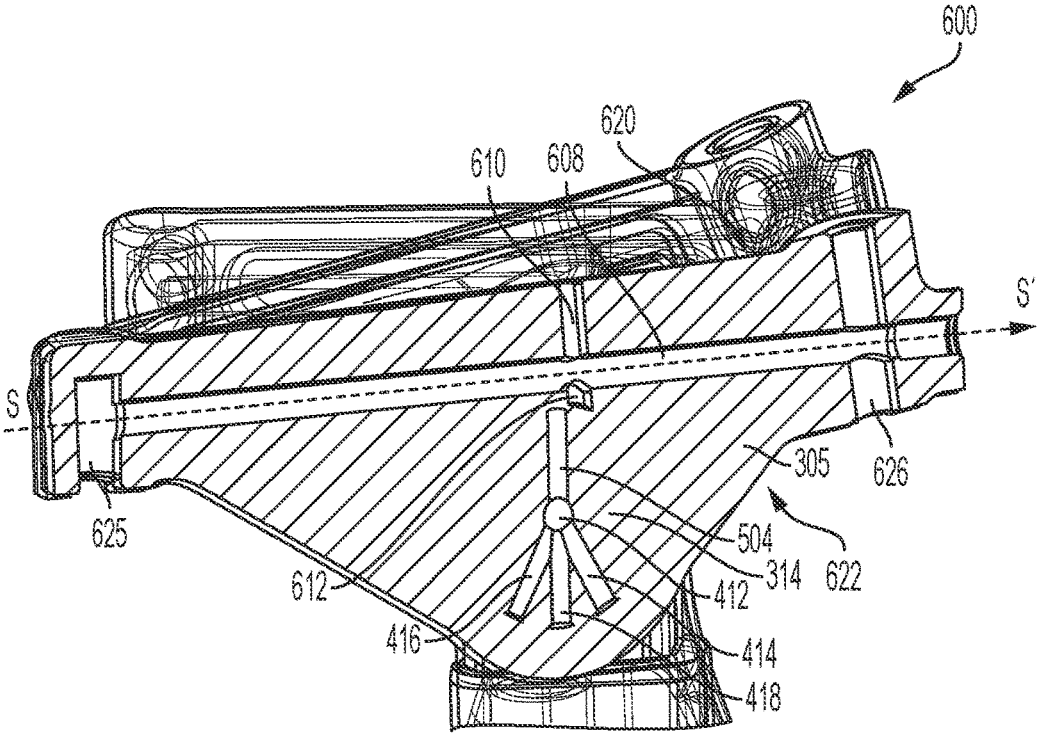
FIG. 6A shows a first position of a first rocker arm coupled to an intake valve.
Figure 6B:
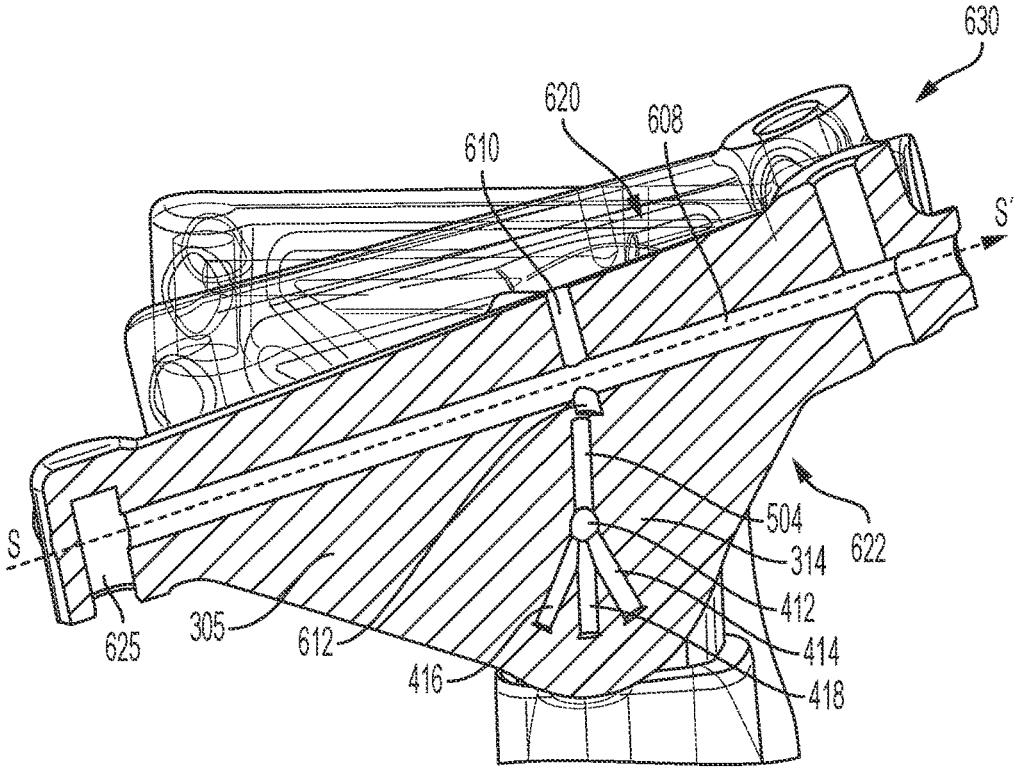
FIG. 6B shows a second position of the first rocker arm coupled to an intake valve.
Figure 6C:
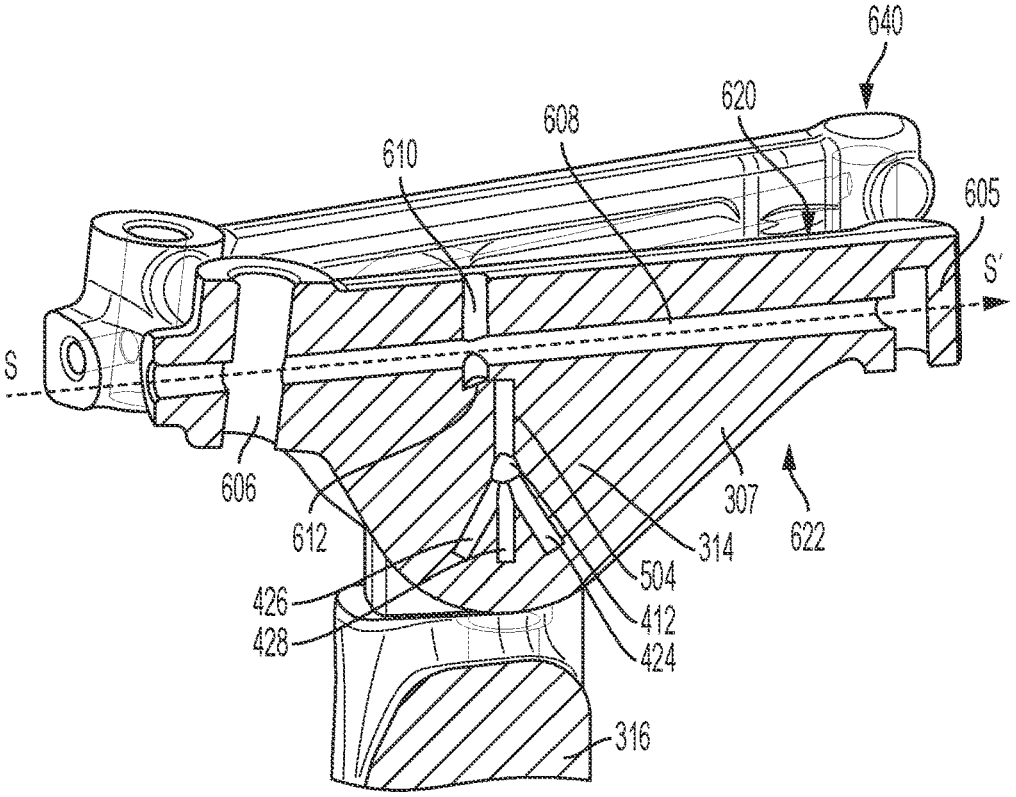
FIG. 6C shows a first position of a second rocker arm coupled to an exhaust valve.
Figure 6D:
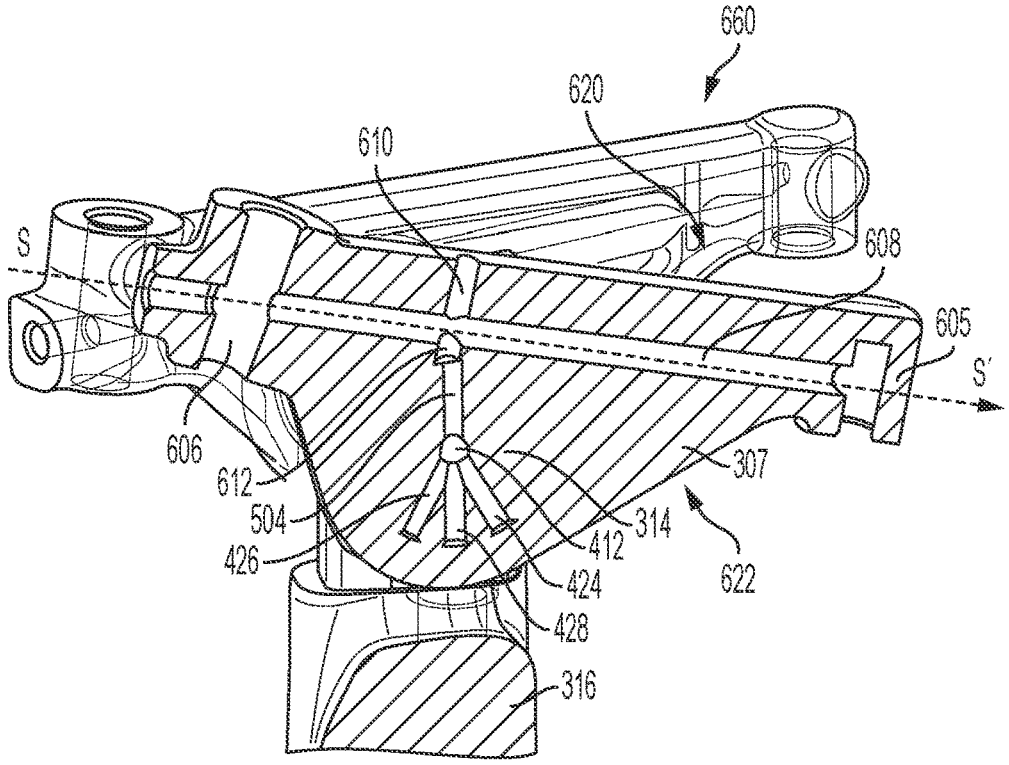
FIG. 6D shows a second position of the second rocker arm coupled to an exhaust valve.
Figure 7:
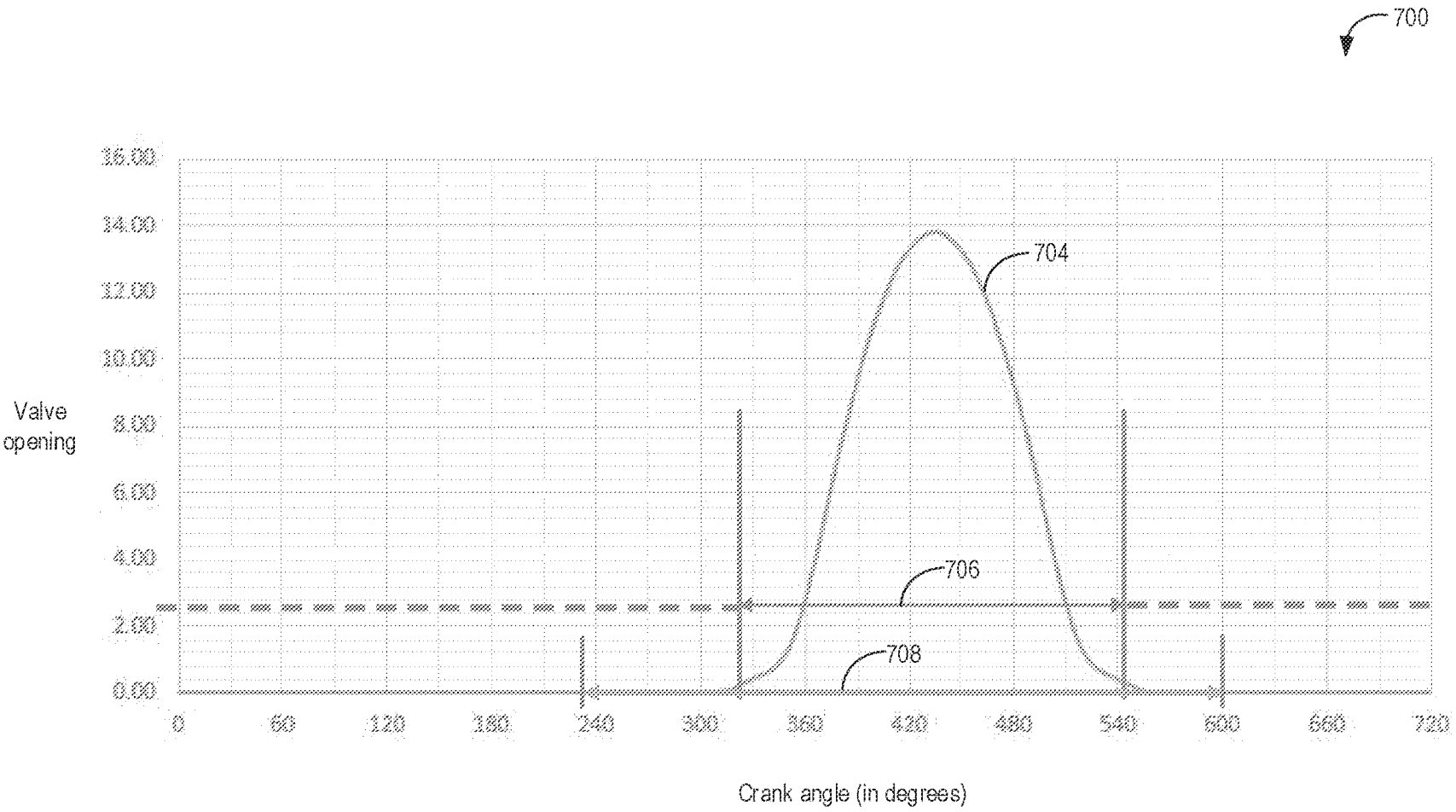
FIG. 7 shows a plot of durations of valve opening and oil supply to a rocker arm tip.

An engine system, such as the engine system shown by FIG. 1, includes rocker arm assemblies for actuating cylinder valves. An example rocker arm assembly coupled to a cylinder valve is shown in FIG. 2. Two rocker arms may pivot about a shared rocker shaft, as shown in FIG. 3. Lubricating oil may be transferred from a cylinder head to the tip of a rocker arm via oil channels in the rocker shaft and a rocker pedestal supporting the rocker shaft, as shown in FIGS. 4-5. FIGS. 6A-6D shows positions of first embodiments of rocker arms coupled to an intake valve and an exhaust valve, respectively, during valve actuation. FIGS. 9A-9D shows positions of second embodiments of rocker arms coupled to an intake valve and an exhaust valve, respectively, during valve actuation. The second embodiment of rocker arms may be covered by a cover shown in FIG. 10. A plot showing durations of valve opening and oil supply to a rocker arm tip is shown in FIG. 7. Intermittent supply of lubricating oil to a tip of a first rocker arm is carried out via a method elaborated in FIG. 8. Intermittent supply of lubricating oil to a tip of a second rocker arm is carried out via a method elaborated in FIG. 11.

Referring to FIG. 1, a block diagram of an embodiment of a vehicle system 100 (e.g., engine system) is shown. In the illustrated embodiment, the vehicle system is a rail vehicle 106 (e.g., locomotive) that can run on a rail 102 via a plurality of wheels 112. The engine system may be disposed in a vehicle. As depicted, the vehicle includes an engine 104, and the engine includes a plurality of combustion chambers (e.g., cylinders). The cylinders of the engine may receive fuel (e.g., diesel fuel) from a fuel system 103 via a fuel conduit 107. In some examples, the fuel conduit may be coupled with a common fuel rail and a plurality of fuel injectors.

The engine 104 may receive intake air for combustion from an intake passage 114. The intake air includes ambient air from outside of the vehicle flowing into the intake passage through an air filter 160. The intake passage may include and/or be coupled to an intake manifold of the engine. Exhaust gas resulting from combustion in the engine is supplied to an exhaust passage 116. Exhaust gas flows through the exhaust passage, to a muffler 117, and out of an exhaust stack 119 of the vehicle.

Each cylinder of engine 104 may include one or more intake valves and one or more exhaust valves. For example, a cylinder may include at least one intake valve and at least one exhaust valve located at an upper region of cylinder. The intake valve and the exhaust valve may be actuated via respective cam actuation system coupled to respective rocker arm assemblies. Cam actuation systems may each include one or more cams and may utilize one or more of cam profile switching (CPS), variable cam timing (VCT), variable valve timing (VVT) and/or variable valve lift (VVL) systems that may be operated by controller to vary valve operation. The position of intake valve and exhaust valve may be determined by valve position sensors. In alternative embodiments, the intake and/or exhaust valve may be controlled by electric valve actuation. For example, a cylinder may alternatively include an intake valve controlled via electric valve actuation and an exhaust valve controlled via cam actuation including CPS and/or VCT systems.

In one example, the vehicle is a diesel-electric vehicle. As depicted in FIG. 1, the engine is coupled to an electric power generation system, which includes an alternator/generator 122 and electric traction motors 124. In one example, the alternator/generator may include a direct current (DC) generator. In other embodiments, the engine may be a diesel engine, a gasoline engine, a biodiesel engine, an alcohol or hydrogen engine, a natural gas engine (spark or compression ignition), or a combination of two or more of the foregoing that generates a torque output during operation. That torque may be transmitted to the electric generator or alternator through a mechanical coupling from the engine. As depicted herein, six pairs of traction motors correspond to each of six pairs of motive wheels of the vehicle. In another example, alternator/generator may be coupled to one or more resistive grids 126. The resistive grids may dissipate excess engine torque and/or electricity generated by traction motors in dynamic braking mode via heat produced by the grids from generated electricity The vehicle system may include a turbocharger 120 that may be arranged between the intake passage and the exhaust passage. In some embodiments, the turbocharger may be replaced with a supercharger. The turbocharger increases air charge of ambient air drawn into the intake passage in order to provide greater charge density during combustion to increase power output and/or engine-operating efficiency. As shown in FIG. 1, the turbocharger may include a compressor 121 (disposed in the intake passage) which is at least partially driven by a turbine 123 (disposed in the exhaust passage). While in this case a single turbocharger may be included, the system may include multiple turbine and/or compressor stages. A temperature sensor 125 may be positioned in the exhaust passage, upstream of an inlet of the turbine. As shown in FIG. 1, a wastegate 127 may be disposed in a bypass passage around the turbine and may be adjusted, via actuation from controller 110, to increase or decrease exhaust gas flow through the turbine. For example, opening the wastegate (or increasing the amount of opening) may decrease exhaust flow through the turbine and correspondingly decrease the rotational speed of the compressor. As a result, less air may enter the engine, thereby decreasing the combustion air-fuel ratio.

The vehicle system may also include a compressor bypass passage 140 coupled directly to the intake passage, upstream of the compressor and upstream of the engine. In one example, the compressor bypass passage may be coupled to the intake passage, upstream of the intake manifold of the engine. The compressor bypass passage may be configured to divert airflow (e.g., from before the compressor inlet) away from the engine (or intake manifold of the engine) and to atmosphere. A compressor bypass valve (CBV) 142 may be positioned in the compressor bypass passage and may include an actuator actuatable by the controller to adjust the amount of intake airflow diverted away from the engine and to atmosphere.

In some embodiments, the vehicle system may further include an aftertreatment system coupled in the exhaust passage upstream and/or downstream of the turbocharger. In one embodiment, the aftertreatment system may include a diesel oxidation catalyst (DOC) and a diesel particulate filter (DPF). In other embodiments, the aftertreatment system may additionally or alternatively include one or more emission control devices. Such emission control devices may include a selective catalytic reduction (SCR) catalyst, three-way catalyst, NOx trap, or various other devices or systems.

The vehicle system shown in FIG. 1 does not include an exhaust gas recirculation (EGR) system. However, in alternate embodiments, the vehicle system may include an EGR system coupled to the engine. The EGR system may route exhaust gas from the exhaust passage of the engine to the intake passage downstream of the turbocharger. In some embodiments, the exhaust gas recirculation system may be coupled exclusively to a group of one or more donor cylinders of the engine (also referred to a donor cylinder system). Also not shown in FIG. 1 is an alternative embodiment that includes an aftertreatment system that receives exhaust coming from the engine during operation.

The vehicle may further include the engine controller (referred to herein as the controller) to control various components and operations related to the vehicle. As an example, various components of the vehicle system may be coupled to the controller via a communication channel or data bus. In one example, the controller includes a computer control system. The controller may additionally or alternatively include a memory holding non-transitory computer readable storage media (not shown) including code for enabling on-board monitoring and control of vehicle operation.

The controller may receive information from a plurality of sensors and may send control signals to a plurality of actuators. The controller, while overseeing control and management of the vehicle, may receive signals from a variety of engine sensors. The signals may be used to determine operating parameters and operating conditions, and correspondingly adjust various engine actuators to control operation of the vehicle. For example, the engine controller may receive signals from various engine sensors including, but not limited to, engine speed, engine load (derived from fueling quantity commanded by the engine controller, fueling quantity indicated by measured fuel system parameters, averaged mean-torque data, and/or electric power output from the alternator or generator), mass airflow amount/rate (e.g., via a mass airflow meter), intake manifold air pressure, boost pressure, exhaust pressure, ambient pressure, ambient temperature, exhaust temperature (such as the exhaust temperature entering the turbine, as determined from the temperature sensor), particulate filter temperature, particulate filter back pressure, engine coolant pressure, exhaust oxides-of-nitrogen quantity (from NOx sensor), exhaust soot quantity (from soot/particulate matter sensor), exhaust gas oxygen level sensor, or the like. Correspondingly, the controller may control the vehicle by sending commands to various components such as the traction motors, the alternator/generator, cylinder valves, fuel injectors, a notch throttle, the compressor bypass valve (or an engine bypass valve in alternate embodiments), a wastegate, or the like. Other actively operating and controlling actuators may be coupled to various locations in the vehicle.

FIG. 2 depict example cross-section 200 of a rocker arm assembly 202 in an internal combustion engine (such as engine 104 in FIG. 1). The rocker arm assembly may include a rocker arm 205 which is configured as an oscillating lever that conveys radial movement from a cam lobe into linear movement at a poppet valve to open it. A rocker arm assembly may be coupled to each valve, such as an intake valve and an exhaust valve in an engine cylinder.

A rocker arm 205 may be coupled to an intake valve 204. Rocker arm 205 may be configured to oscillate (rock) about a pivot point 218 at a center of a rocker shaft 217. The rocker arm may include a rocker shaft 217 counted on a bush bearing to facilitate the oscillating motion of the rocker arm 202. The rocker shaft 217 may be shared between a plurality of rocker arms, such as a first rocker arm coupled to an intake valve and a second rocker arm coupled to an exhaust valve of an engine cylinder.

The rocker arm 205 conveys radial movement from the lobe of cam 206 into linear movement at poppet intake valve 204 to change a valve lift amount. By changing the lift of the intake valve 204, the actuator may selectively open and close the intake port 208 of combustion chamber 14 defined in cylinder head 210 of engine. Camshaft 212 is formed with intake valve drive cam 206 for actuating the intake valve. The inner end 214 of the rocker arm is raised and lowered by the rotating lobes of cam 206 to allow the rocker arm to engage and activate valve stem 224. The drive cam 206 may be coupled to the inner end 214 of the rocker arm 202 via a lifter 227 and a pushrod 220. In alternate embodiments, the drive cam 206 may be directly in face sharing contact with the rocker arm 202. The motion at the outer end 213 of the rocker arm (also referred herein as tip of rocker arm) is transmitted to the valve stem 224.

As the cam lobe rotates on the camshaft 212, it causes the inner end 214 of the rocker arm 202 to be raised while at the same time the outer end 213 presses down on the valve stem 224, thereby opening the intake valve 204. When the rotating cam lobe causes the inner end 214 of the rocker arm to be lowered, the outer end 213 rises causing the return spring 222 to close the valve. While the depicted examples only show an intake valve drive cam, it will be appreciated that similar configurations may be present for an exhaust valve drive cam. Further the exhaust valve drive cam may be located axially next to the intake valve drive cam along the camshaft.

In order to facilitate the oscillating motion of the rocker arm 202 and the actuation of the valve 204, lubricating oil is supplied to the rocker arm and further to the outer end, tip, 213 of the rocker arm. During a first condition, lubricating oil may be routed to a tip of a rocker arm via a supply groove fluidically connecting a first channel carrying the lubricating oil to a second channel leading to the tip of the rocker; and during a second condition, flow of lubricating oil to the tip may be suspended by offsetting the first channel from the second channel. The first condition may include a valve coupled to the tip of the rocker arm in an open position, and the second condition includes the valve coupled to the tip of the rocker arm in a closed position, the valve being one of an intake valve and an exhaust valve. The first channel may carry lubricating oil from a cylinder head to the second channel though one or more of a pillar of a rocker pedestal and a rocker shaft passing through a pivot point of the rocker arm, the rocker arm oscillating about the pivot point. During each of the first condition and the second condition, at least a portion of the lubricating from the first channel may be routed to a set of draining channels leading to a bearing configured to oscillate the rocker arm. FIGS. 4-5 shows oil channels supplying lubricating oil to the rocker arm assembly.

FIG. 3 an example arrangement 300 of a first rocker arms assembly 304 and a second rocker arm assembly 306 coupled to an engine cylinder housed within an engine block 328. A first end (tip) of a first rocker arm 305 may be coupled to a first valve lift mechanism 310 of an intake valve and a first end (tip) of a second rocker arm 307 may be coupled to a second valve lift mechanism 312 of an exhaust valve of the engine cylinder. Each of the first valve lift mechanism 310 and the second valve lift mechanism 312 may include a pair of return springs coupled to a valve stem and a valve attached to an end of the valve stem distal from the return springs. A second end of the first rocker arm 305 may be coupled to a first drive cam via a first pushrod 309 and a second end of the second rocker arm 307 may be coupled to a second drive cam via a second pushrod (not shown).

Each of the first rocker arm 305 and the second rocker arm 307 may have openings (rocker bores) in center. A continuous rocker shaft 314 may pass through each of the respective central openings in the first rocker arm 305 and the second rocker arm 307 along a A-A' axis. A first bush bearing 324 may surround an inner wall of the rocker shaft 314 within the first central opening in the first rocker 305 and a second bush bearing 326 may enclose the rocker shaft within the second central opening in the second rocker 307. Each rocker arm may oscillate about the rocker shaft 314 to selectively open and close the valve coupled to the rocker arm.

Pillars of a rocker pedestal 316 may support portions of the rocker shaft 314 not passing through openings within the rocker arms such as a portion of the rocker shaft 314 between two rocker arms or beyond the second rocker arm 307. The rocker pedestal 316 may include pillars in face sharing contact with such portions of the rocker shaft 314 not passing through openings within the rocker arms. While the portion of the rocker shaft 314 that passes through the openings within the rocker arms are not in contact with the pillars of rocker pedestal 314. The pillars of the rocker pedestal 316 may be positioned between the cylinder head housed within the engine block 328 and the rocker shaft 314. As further elaborated in relation to FIGS. 4-5, lubricating oil may be supplied from an oil sump at the cylinder head to the rocker arms via each of the pillars of rocker pedestal 316 and the rocker shaft 314.

FIG. 4 shows an example cross-section 400 of the rocker shaft 314 passing through a first rocker arm 305 and a second rocker arm 307. The cross-section of the rocker shaft 314 is taken along a horizontal plane formed by the axes A-A' and B-B' in FIG. 3. The components of the rocker assembly arrangement as previously introduced are numbered similarly and not reintroduced.

A central, first horizontal oil channel 412 may pass through the center of the rocker shaft 314 along the axis A-A'. Oil may be supplied to the first horizontal oil channel 412 from vertical oil channels within the rocker pedestal 316 via a first inlet 404 and a second inlet 406 (as further shown in FIG. 5). A first set of draining oil channels may be located at a center of the portion of the rocker shaft 314 that is within an opening of the first rocker arm 305. The center of the portion of the rocker shaft 314 that is within an opening of the first rocker arm 305 is the pivot point (such as pivot point 218 in FIG. 2) for oscillation of the first rocker arm 305. The first set of draining oil channels may include a first passage 414, a second passage 416, and a third passage 418. Each of the first passage 414, the second passage 416, and the third passage 418 may lead to a bush bearing surrounding the opening (bore) of the first rocker arm 305. Similarly, a second set of draining oil channels may be located at a center of the portion of the rocker shaft 314 that is within an opening of the second rocker arm 307. The center of the portion of the rocker shaft 314 that is within an opening of the second rocker arm 307 is the pivot point (such as pivot point 218 in FIG. 2) for oscillation of the second rocker arm 307. The second set of draining oil channels may include a fourth passage 424, a fifth passage 426, and a sixth passage 428. Each of the fourth passage 424, the fifth passage 426, and the sixth passage 428 may lead to a bush bearing surrounding the opening (bore) of the second rocker arm 307.

Lubricating oil from the cylinder head may flow vertically through vertical oil channels within the rocker pedestal 316 and then enter the first horizontal oil channel 412 at each of the first inlet 404 and the second inlet 406. The oil may horizontally flow through the first horizontal oil channel 412 and then intermittently flow to a second horizontal oil channel through the rocker arm (along its length). The intermittent flow of oil to the second horizontal oil channel is discussed in details in FIGS. 6A-6D. During conditions when oil is not supplied to the second horizontal oil channel in the rocker arm, oil from the first horizontal oil channel may flow through the first set of draining oil channels and the second set of draining oil channels to lubricate the bush bearings along the bores of the rocker arms. By supplying lubricating oil to the bush bearings, oscillating motion of the rocker arm about their respective pivot points in the rocker shaft 314 may be improved.

Further, the flow of oil to the first horizontal oil channel 412 from the cylinder head may be enabled, such as by opening one or more valves coupled to the vertical oil channels within the rocker pedestal , during conditions when the oil is supplied to the second horizontal oil channel, and during conditions when the oil is not supplied to the second horizontal oil channel, oil flow to the first horizontal oil channel 412 may be disabled by closing the one or more valves coupled to the vertical oil channels.

FIG. 5 shows an example cross-section 500 of a rocker pedestal 316 including oil channels, the rocker pedestal 316 supporting a rocker shaft 314 passing through a first rocker arm 305 and a second rocker arm. A first, vertical oil channel 508 may pass through a longitudinal axis C-C' of a pillar of the rocker pedestal 316. The rocker pedestal 316 may have multiple pillars supporting portions of the rocker shaft 314 not passing through the rocker arms. Multiple vertical oil channels may pass through the separate pillars of the rocker pedestal 316. Each vertical oil channel 508 may end in an inlet (such as first inlet 404 and a second inlet 406) leading to a first, horizontal channel 412 passing through the rocker shaft 314.

A first set of draining oil channels may originate from the first, horizontal channel 412at a center of the portion of the rocker shaft 314 that is within an opening of the first rocker arm 305. The center of the portion of the rocker shaft 314 that is within an opening of the first rocker arm 305 is the pivot point (such as pivot point 218 in FIG. 2) for oscillation of the first rocker arm 305. The first set of draining oil channels may include a first passage 414, a second passage 416, and a third passage 418. Each of the first passage 414, the second passage 416, and the third passage 418 may lead to a bush bearing 324 surrounding the opening (bore) of the first rocker arm 305.

A second, vertical oil channel 504 may also originate from the first, horizontal channel 412 at a center of the portion of the rocker shaft 314 that is within an opening of the first rocker arm 305. The second, vertical oil channel 504 may extend radially across the rocker shaft 314 from the center (pivot point) of the rocker shaft 314 to the periphery of the rocker shaft 314. The second, vertical oil channel 504 may be perpendicular to the first, horizontal channel 412. The second, vertical oil channel 504 may couple the first, horizontal channel 412 to a second, horizontal oil channel passing through the rocker arm (as seen in FIGS. 6A and 6B). In one example, a diameter of the first vertical oil channel 508 may be higher than that of each of the second vertical oil channel 504, the first passage 414, the second passage 416, and the third passage 418.

Oil from the cylinder head may flow to the first horizontal channel 412 through the first vertical channel 508 and from thereon may be intermittently supplied to a second horizontal channel (within the rocker arm) via the second vertical channel 504. Alternatively, in absence of the second horizontal channel within the rocker arm, the oil may be splashed to a rocker arm cover and from thereon, the oil may drip to the rocker arm.

FIGS. 6A and 6B show a cross-section of the first position 600 and a cross-section of a second position 630 of a first rocker arm 305 coupled to an intake valve of a cylinder, respectively. FIGS. 6C and 6D show a first position 640 and a second position 660 of a second rocker arm 307 coupled to an exhaust valve of the cylinder, respectively. Each of the first rocker arm 305 and the second rocker arm 307 may be a first embodiment of the rocker arm 205 in FIG. 2.

A rocker shaft 314 may be shared between the first rocker arm 305 and the second rocker arm 307 and each rocker arm may oscillate about the pivot point at the center of the portion of the rocker shaft 314 that is within an opening of the respective rocker arm. As shown in this example, a first, horizontal oil channel 412 passes through the pivot point of each rocker arm. In this example, each of the first rocker arm 305 and the second rocker arm 307 may include a horizontal arm 620 along the S-S' axis and a triangular section 622 directly below the horizontal arm 620. The rocker shaft 314 may pass through a bore in the triangular section 622.

A first end (tip) 625 of the horizontal arm of a first rocker arm 305 may be coupled to a first valve lift mechanism of an intake valve and a first end (tip) 605 of horizontal arm of the second rocker arm 307 may be coupled to a second valve lift mechanism of an exhaust valve of the engine cylinder. Each of the first valve lift mechanism and the second valve lift mechanism may include a pair of return springs coupled to a valve stem and a valve attached to an end of the valve stem distal from the return springs. A second end 626 of the first rocker arm 305 may be coupled to a first drive cam via a first pushrod and a second end 606 of the second rocker arm 307 may be coupled to a second drive cam via a second pushrod.

A second horizontal channel 608 may be positioned through the horizontal arms of each rocker arm along the S-S' axis. The second horizontal channel 608 may span the entire length of a horizontal arm between the first end and the second end of the rocker arm. In one example, vertical oil channels may be positioned at each end of the second horizontal channel 608. A second, vertical oil channel 504 may also originate from the first, horizontal channel 412 at a center (pivot point) of the portion of the rocker shaft 314 that is within an opening of the first rocker arm 305. The second, vertical oil channel 504 may couple the first, horizontal channel 412 to the second, horizontal oil channel 608 passing through the rocker arm via a supply groove 612. Based on a position of the rocker arm such as an angle of the rocker arm relative to the second, vertical oil channel 504, the supply groove may be offset with the second, vertical oil channel 504 or aligned with the second, vertical oil channel 504.

A set of draining oil channels may originate from the first, horizontal channel 412 at a center (pivot point) of the portion of the rocker shaft 314 that is within an opening of the first rocker arm 305 and diverge towards a bush bearing surrounding the inner wall of the rocker shaft 314. The set of draining oil channels may include a first passage 414, a second passage 416, and a third passage 418. The third passage 418 may be linear to the second, vertical oil channel 504 and extend in a direction away from the second horizontal channel 608. The first passage 414 and the second passage 416 may be on either side of the third passage 418 with an angle between the first passage 414 and the third passage 418 being substantially equal to an angle between the second passage 416 and the third passage 418. A third, vertical channel 610, aligned with the supply groove 612 may continue towards the top surface of the rocker arm through the second, horizontal oil channel 608.

During a first condition, as shown in FIG. 6A, the intake valve at the end of the valve stem coupled to the first end (tip) 625 of the first rocker arm 305 is closed. In this condition, there is an offset between the second, vertical oil channel 504 and supply groove 612, thereby disconnecting the first horizontal channel 412 from the second horizontal channel 608. Due to the offset between the second, vertical oil channel 504 and supply groove 612, oil from the first horizontal channel 412 cannot flow to first end 625 of the rocker arm and the valve stem of the intake valve via the supply groove and the second horizontal channel 608. In one example, oil flow from the cylinder head to the first horizontal channel 412 during the first condition may be reduced and the oil flowing through the first horizontal channel 412 may be routed through the draining oil channels such as the first passage 414, a second passage 416, and a third passage 418 to a bottom of rocker shaft/rocker bore to lubricate the bush bearing and the rocker shaft 314 enclosed within the bush bearing and thereby facilitate the oscillating motion of the rocker arm. By inhibiting oil flow to the intake valve during a closed state of the valve flooding of the valve stem seal may be reduced. Further, by supplying oil to the mechanical parts of the rocker shaft via the draining oil channels, friction between adjacent metallic surfaces may be reduced, thereby reducing wear of interface.

During a second condition, as shown in FIG. 6B, the intake valve at the end of the valve stem coupled to the first end (tip) 625 of the first rocker arm 305 is opened. A cam lobe rotates on a camshaft causing the first end 625 to press down on the valve stem, thereby opening the intake valve. In this condition, the second vertical oil channel 504 and supply groove 612 are aligned, thereby fluidically connecting the first horizontal channel 412 with the second horizontal channel 608. Due to the alignment of the second, vertical oil channel 504 and supply groove 612, oil from the first horizontal channel 412 may flow to first end 605 of the rocker arm and the valve stem of the intake valve via the supply groove and the second horizontal channel 608. In one example, oil flow from the cylinder head to the first horizontal channel 412 during the second condition may be increased. A first portion the oil flowing through the first horizontal channel 412 may be routed to the valve stem of the intake valve via the second horizontal channel 608 and the first end 625 while a second portion of the oil may be routed to the draining oil channels such as the first passage 414, a second passage 416, and a third passage 418 to lubricate the bush bearing and the rocker shaft 314 enclosed within the bush bearing. In this way, lubricating oil may be intermittently supplied to a tip of a rocker arm and a corresponding valve stem during actuation of the valve coupled to it.

FIG. 7 shows a plot 700 of a duration of valve opening and oil supply to a tip (such as first end 605 in FIGS. 6A and 6B) of a rocker arm (such as rocker arm 305 in FIGS. 6A and 6B). The x-axis shows crank angle (in degree) and the y-axis shows a degree of valve opening. Plot 704 shows the opening valve coupled to the tip of the rocker arm. A first arrow 706 shows a first duration of valve opening and a second arrow 708 shows a second duration of oil supply from a cylinder head to a tip of a rocker arm and the valve stem of the valve coupled to the tip. As seen from the plot, instead of a continuous oil supply to the valve, lubricating oil may be supplied intermittently to cover the duration of valve opening.

Returning to FIG. 6C, during a third condition (as shown in FIG. 6C) the exhaust valve at the end of the valve stem coupled to the first end (tip) 605 of the second rocker arm 307 is closed. In this condition, there is an offset between the second, vertical oil channel 504 and supply groove 612, thereby disconnecting the first horizontal channel 412 from the second horizontal channel 608. Due to the offset between the second, vertical oil channel 504 and supply groove 612, oil from the first horizontal channel 412 cannot flow to first end 605 of the rocker arm and the valve stem of the exhaust valve via the supply groove and the second horizontal channel 608. In one example, oil flow from the cylinder head to the first horizontal channel 412 during the first condition may be reduced and the oil flowing through the first horizontal channel 412 may be routed through the draining oil channels such as the third passage 424, a fourth passage 426, and a fifth passage 428 to lubricate the bush bearing and the rocker shaft 314 enclosed within the bush bearing and thereby facilitate the oscillating motion of the rocker arm. By inhibiting oil flow to the exhaust valve during a closed state of the valve flooding of the valve stem seal may be reduced.

During a fourth condition, as shown in FIG. 6D, the exhaust valve at the end of the valve stem coupled to the first end (tip) 605 of the second rocker arm 307 is opened. A cam lobe rotates on a camshaft causing the first end 605 to press down on the valve stem, thereby opening the exhaust valve. In this condition, the second vertical oil channel 504 and supply groove 612 are aligned, thereby fluidically connecting the first horizontal channel 412 with the second horizontal channel 608. Due to the alignment of the second, vertical oil channel 504 and supply groove 612, oil from the first horizontal channel 412 may flow to first end 625 of the rocker arm and the valve stem of the exhaust valve via the supply groove and the second horizontal channel 608. In one example, oil flow from the cylinder head to the first horizontal channel 412 during the second condition may be increased. A first portion the oil flowing through the first horizontal channel 412 may be routed to the valve stem of the exhaust valve via the second horizontal channel 608 and the first end 605 while a second portion of the oil may be routed to the draining oil channels such as the fourth passage 424, a fifth passage 426, and a sixth passage 428 to lubricate the bush bearing and the rocker shaft 314 enclosed within the bush bearing. In this way, lubricating oil may be intermittently supplied to a tip of a rocker arm and a corresponding valve stem during actuation of the valve coupled to it.

Figure 8:
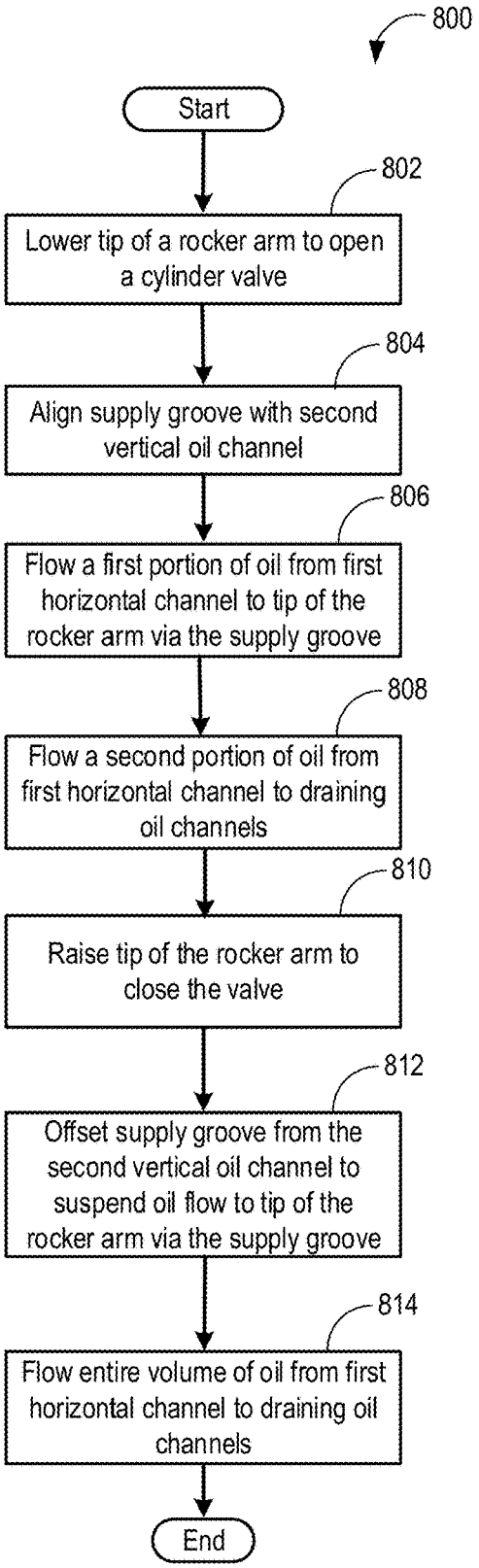
FIG. 8 shows a first flow-chart illustrating an example method for intermittently supplying lubricating oil to a tip of a rocker arm according to a first embodiment.

FIG. 8 shows a first example method 800 for intermittently supplying lubricating oil to a tip of a rocker arm. In this example, a first embodiment of rocker arm (such as first rocker arm 305 and second rocker arm 307 in FIGS. 6A-6D) may include a horizontal channel formed within the rocker arm to supply lubricating oil to rocker arm tips during an opening of a corresponding valve coupled to the rocker arm. Instructions for carrying out method 800 and the rest of the methods included herein may be executed by a controller based on instructions stored on a memory of the controller and in conjunction with signals received from sensors of the engine system, such as the sensors described above with reference to FIG. 1. The controller may employ engine actuators of the vehicle system to adjust engine operation, according to the methods described below.

At 802, a tip (such as a first end) of a rocker arm may be lowered to open a cylinder valve. The valve may be an intake valve or an exhaust valve. Rotation of a cam lobe on a camshaft may cause the tip of the rocker arm to press down on a valve stem of the cylinder valve, thereby opening the valve.

At 804, as the tip of the rocker arm is lowered, a supply groove (such as supply groove 612 in FIGS. 6A and 6B) may be aligned with a second vertical oil channel (such as second vertical oil channel 504 in FIGS. 6A and 6B) which in turn may be coupled to a central first horizontal oil channel passing through the center of a rocker shaft of the rocker arm.

At 806, a first portion of lubricating oil may be supplied from the central first horizontal oil channel to the tip of the rocker arm via the supply groove and a second horizontal channel (such as second horizontal channel 608 in FIGS. 6A and 6B) passing through the rocker arm. Oil from a cylinder head may flow to the first horizontal channel through a first vertical channel (such as first vertical channel 508 in FIG. 5) formed within a rocker pedestal supporting the rocker shaft. Oil at the tip of the rocker arm may lubricate a valve stem coupled to the tip.

At 808, a second portion of the lubricating oil may flow from the central first horizontal oil channel to one or more draining oil channels leading to a lower portion of the rocker shaft/rocker bore such as to a bearing around the rocker shaft to facilitate movement of the rocker arm about the bearing. By supplying oil to the lower part of the rocker shaft via the draining oil channels, friction between adjacent metallic surfaces may be reduced, thereby reducing wear of interfaces. In one example, the first portion of oil supplied to the tip of the rocker arm may be higher than the second portion of oil routed to the draining oil channels.

At 810, the tip of the rocker arm may be raised to close the open valve. Rotation of the cam lobe on the camshaft may cause the tip of the rocker arm to be raised, causing a return spring coupled to the valve stem to close the valve. Due to the change in inclination of the rocker arm, at 812, the supply groove may become offset from the second vertical oil channel and oil flow from the second horizontal channel to the tip of the rocker arm via the second vertical oil channel and the supply groove may be suspended. Therefore, upon closure of a cylinder valve, oil may no longer be supplied to the tip of the rocker arm coupled to that valve.

At 814, entire volume of oil may flow from the central first horizontal oil channel to the one or more draining oil channels leading to the bearing around the rocker shaft facilitating movement of the rocker arm about the bearing.

In this way, a system for an engine may comprise a first channel axially extending along a rocker arm up to a tip of the rocker arm coupled to a valve, a second channel fluidically coupled to an oil sump at a cylinder head at a first end, and a supply groove selectively aligned with the first channel based on an angle of the rocker arm. The selectively aligning may include the supply groove being aligned with the first channel upon the tip of the rocker arm being lowered during opening of the valve, and the supply groove being offset with the first channel upon the tip of the rocker ram arm being raised upon closing of the valve.

Figure 9A:
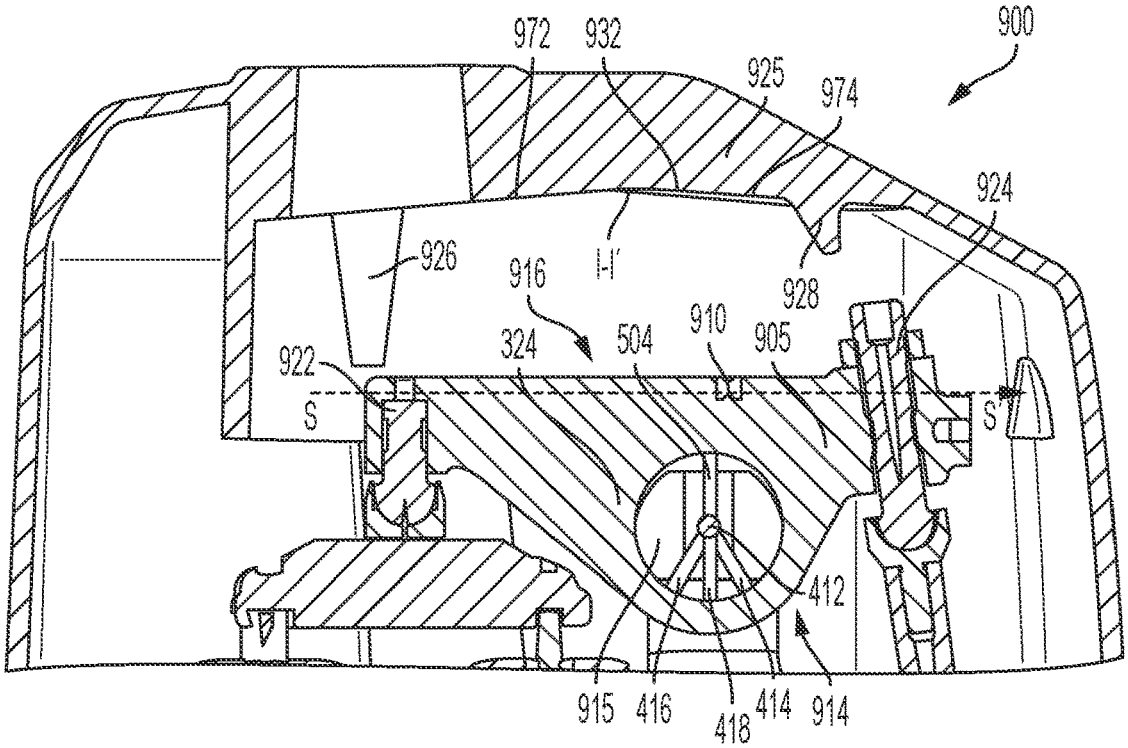
FIG. 9A shows a first position of a third rocker arm coupled to an intake valve.
Figure 9B:
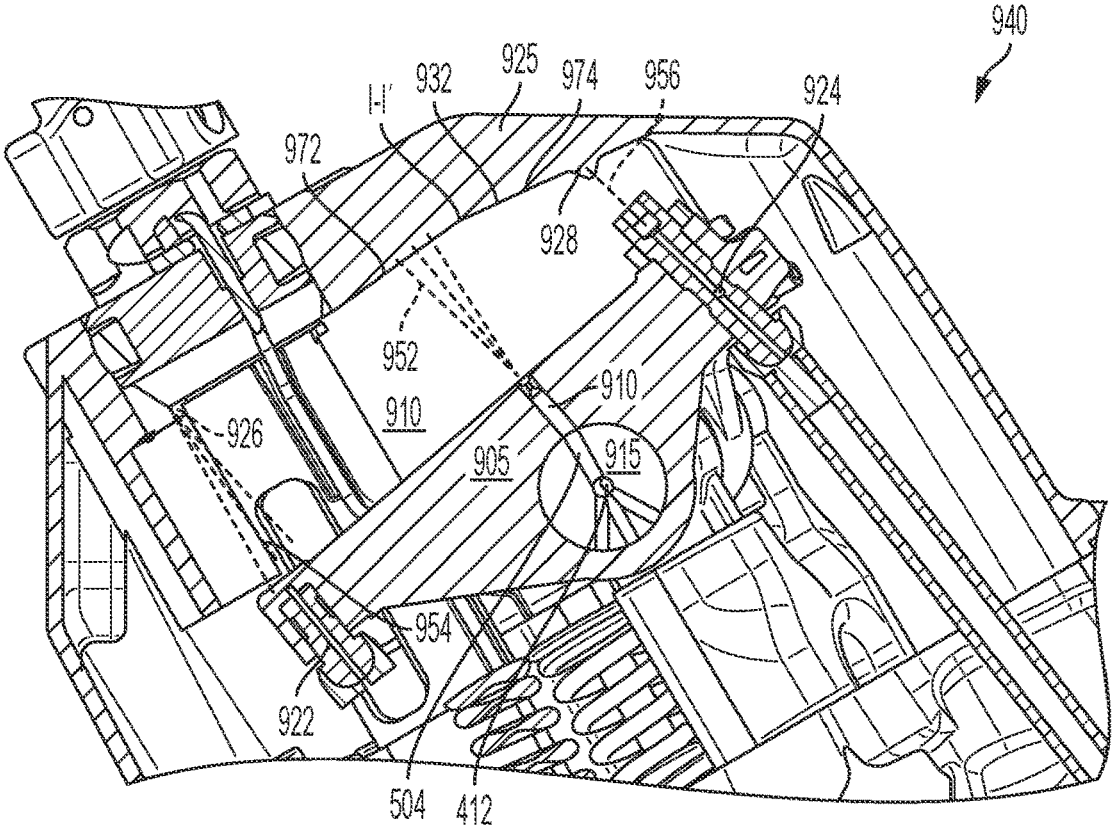
FIG. 9B shows a second position of the third rocker arm coupled to an intake valve.
Figure 9C:
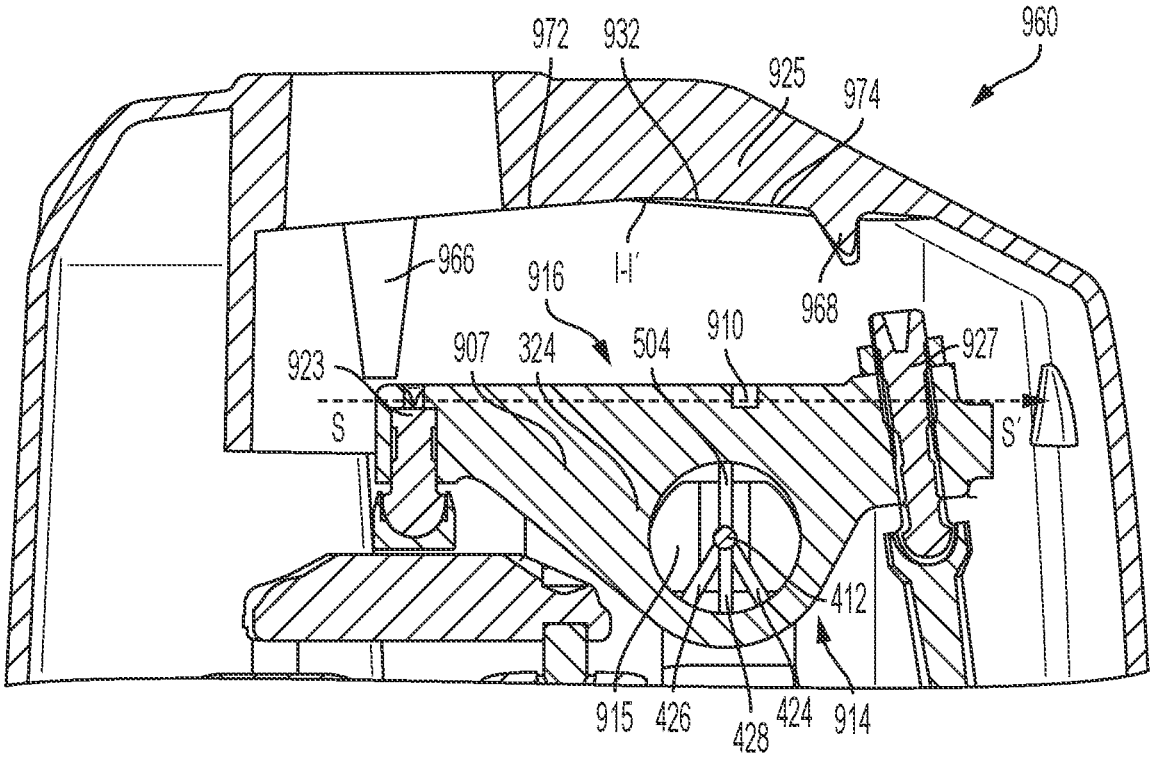
FIG. 9C shows a first position of a fourth rocker arm coupled to an exhaust valve.
Figure 9D:
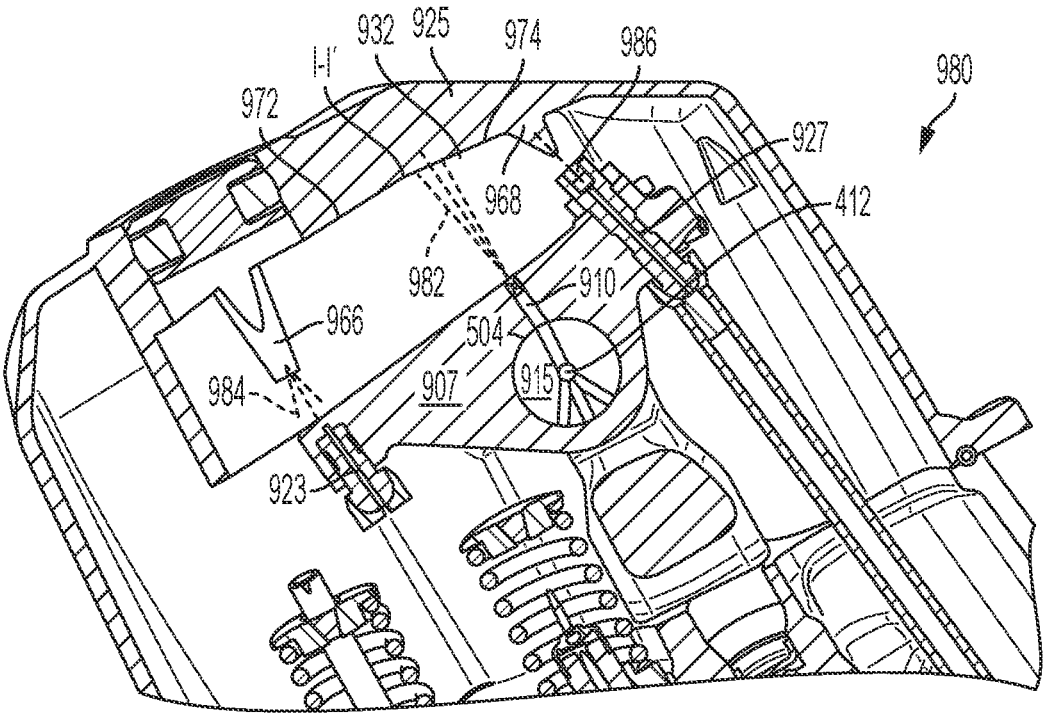
FIG. 9D shows a second position of the fourth rocker arm coupled to an exhaust valve.

FIGS. 9A and 9B show a cross-section of the first position 900 and a cross-section of a second position 940, respectively, of a third rocker arm 905 coupled to an intake valve of a cylinder. FIGS. 9C and 9D show a first position 960 and a second position 980, respectively, of a fourth rocker arm 907 coupled to an exhaust valve of the cylinder. Each of the third rocker arm 905 and the fourth rocker arm 907 may be a second embodiment of the rocker arm 205 in FIG. 2.

A rocker shaft may be shared between the third rocker arm 905 and the fourth rocker arm 907 and each rocker arm may oscillate about the pivot point at the center of the portion of the rocker shaft that is within an opening (bore) 915 of the respective rocker arm. As shown in this example, a first, horizontal oil channel 412 passes through the pivot point of each rocker arm. In this example, each of the third rocker arm 905 and the fourth rocker arm 907 may include a horizontal section 916 along the S-S' axis and a triangular section 914 directly below the horizontal arm 620. The rocker shaft may pass through the opening 915 in the triangular section 914.

A first end (tip) of the horizontal arm of a third rocker arm 905 may be coupled to a first valve lift mechanism 922 of an intake valve and a first end (tip) of horizontal arm of the fourth rocker arm 907 may be coupled to a second valve lift mechanism 923 of an exhaust valve of the engine cylinder. Each of the first valve lift mechanism 922 and the second valve lift mechanism 923 may include a valve adjuster shaped as an elephant foot with a rectangular upper portion and a spherical lower portion, and a pair of return springs coupled to a valve stem and a valve attached to an end of the valve stem distal from the return springs. A spherical lower portion (ball) of the elephant foot may form a spherical interface with a complementary cup (socket) shaped geometry of a valve train component. A second end of the third rocker arm 905 may be coupled to a first drive cam via a first pushrod system 924 including a lash adjuster and a second end of the fourth rocker arm 907 may be coupled to a second drive cam via a second pushrod system 924 including a lash adjuster.

Figure 10:
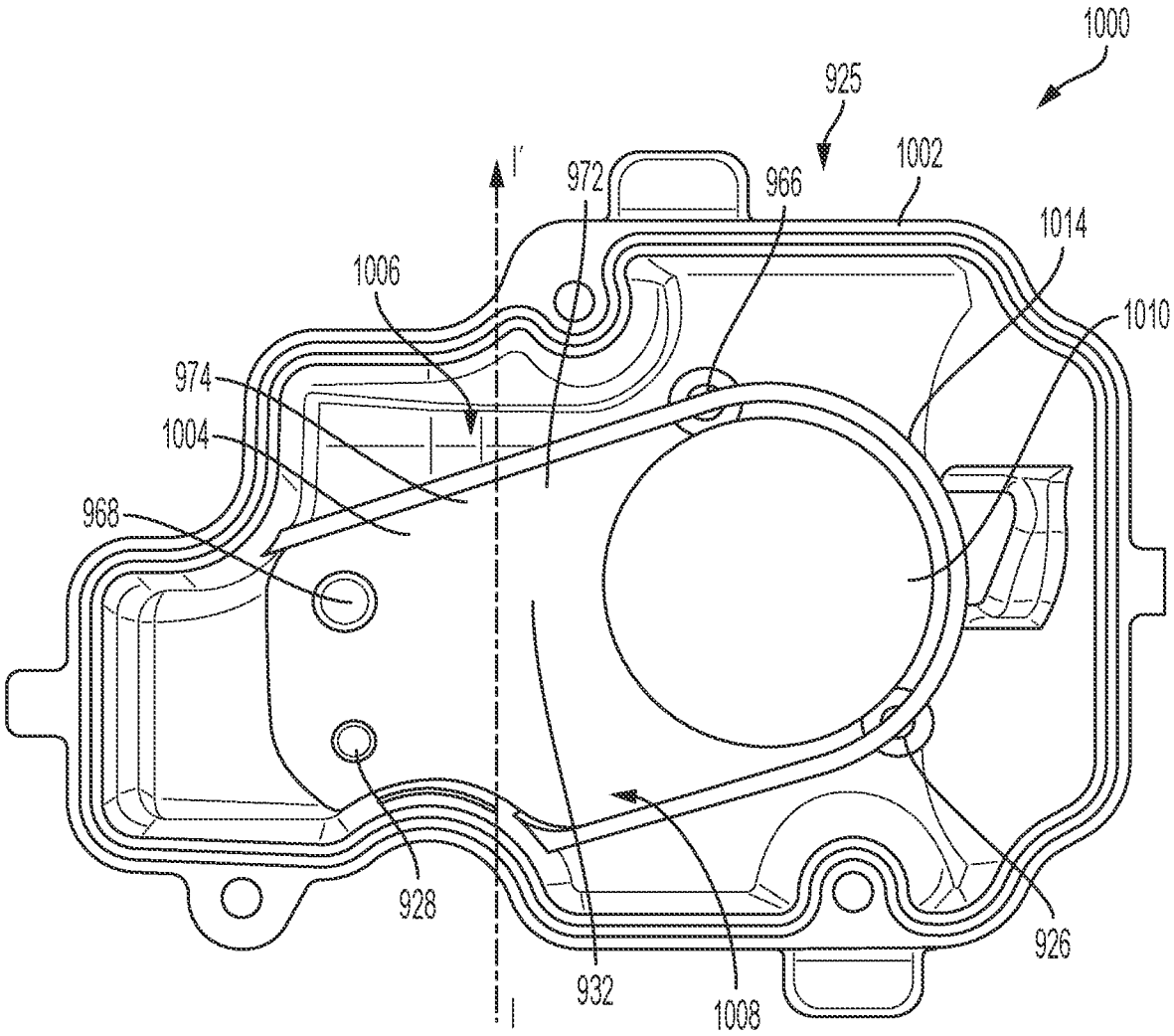
FIG. 10 shows a cover of rockers arms.

A continuous cover 925 may be placed over each of the third rocker arm 905 and the fourth rocker arm 907. The single cover 925 may enclose both the rocker arms. FIG. 10 shows a bottom view 1000 of the cover 925 facing the rocker arms. The cover may include a casing 1002 including an insert 1004. The insert 1004 may include a u-shaped wall 1014 along the perimeter of the insert 1004. The third rocker arm coupled to the intake valve may be positioned under a first side 1008 of the cover 925 and the fourth rocker arm coupled to the exhaust valve may be positioned under a second side 1006 of the cover 925.

The insert may include an opening 1010 towards one end of the cover 925. A first set of protrusions including a first protrusion 926 and a second protrusion 966 may be placed on two sides of the opening 1010. A second set of protrusions including a third protrusion 928 and a fourth protrusion 968 may be placed proximal to another side of the cover 925 distal from the opening 1010. Each of the first protrusion 926, the second protrusion 966, the third protrusion 928, and the fourth protrusion 968 may of conical shape with a broader base and a pointed tip. The first protrusion 926 and the second protrusion 966 may intersect with the wall 1014 and may be bigger in size (such as diameter of base and distance between base and tip) compared to the third protrusion 928 and the fourth protrusion 968.

The first protrusion 926 and the third protrusion 928 may be placed over the third rocker arm 905 while the second protrusion 966 and the fourth protrusion 968 may be placed over the fourth rocker arm 907. The first protrusion 926 and the second protrusion 966 may be placed directly over the valve lift mechanism coupled to the respective rocker arm while the third protrusion 928 and the fourth protrusion 968 may be placed directly over the pushrod coupled to the respective rocker arm. The tips (ends) of each of the first protrusion 926 and the second protrusion 966 may directly face the valve lift mechanism while the tips (ends) of each of the third protrusion 928 and the fourth protrusion 968 may directly face the respective pushrods.

The surface 932 of the insert 1004 facing the rocker arms may be inclined on each side of the axis I-I' with a ridge formed along the I-I' axis. The surface 932 of the insert 1004 may slope away downward from the ridge along the axis I-I' on both sides of the ridge. Due to the slope leading away from the ridge in a first direction, a first portion of fluid from the ridge may trickle down a first segment 972 of the surface 932 leading to the first set of protrusions including (first protrusion 926 and second protrusion 966) positioned on the first segment 972. Also, due to the slope leading away from the ridge in a second direction, a second portion of fluid from the ridge may trickle down a second segment 974 of the surface 932 leading to the second set of protrusions including (third protrusion 928 and fourth protrusion 968) positioned on the second segment 974. Each of the protrusions may allow the fluid to concentrate and trickle down from the pointed ends.

Returning to FIGS. 9A-9D, a second, vertical oil channel 504 may also originate from the first, horizontal channel 412 at a center (pivot point) of the portion of the rocker shaft 314 that is within respective openings of the third rocker arm 905 and the fourth rocker arm 907. The second, vertical oil channel 504 may couple the first, horizontal channel 412 a supply channel 910. The supply channel 910 may extend from the circumference of the opening 915 to the top surface of the respective rocker arm. The supply channel 910 may have an opening at the end facing the cover 925 on the rocker arms. Based on a position of the rocker arm such as an angle of the rocker arm relative to the second, vertical oil channel 504, the supply channel 910 may be offset with the second, vertical oil channel 504 or aligned with the second, vertical oil channel 504.

A set of draining oil channels may originate from the first, horizontal channel 412 at a center (pivot point) of the portion of the rocker shaft 314 that is within an opening of each of the third rocker arm 905 and the fourth rocker arm 907 and diverge towards a bush bearing surrounding the inner wall of the rocker shaft 314. A first set of draining oil channels included in the third rocker arm 905 may include a first passage 414, a second passage 416, and a third passage 418. The third passage 418 may be linear to the second, vertical oil channel 504 and extend in a direction away from the second horizontal channel 608. The first passage 414 and the second passage 416 may be on either side of the third passage 418 with an angle between the first passage 414 and the third passage 418 being substantially equal to an angle between the second passage 416 and the third passage 418. Similarly, a second set of draining oil channels included in the fourth rocker arm 907 may include a fourth passage 424, a fifth passage 426, and a sixth passage 428.

During a first condition for the intake valve, as shown in FIG. 9A, the intake valve at the end of the first valve lift mechanism 922 coupled to the first end of the rocker arm 905 is closed. In this condition, there is an offset between the second, vertical oil channel 504 and supply channel 910, thereby disconnecting the first horizontal channel 412 from the supply channel 910. Due to the offset between the second, vertical oil channel 504 and supply channel 910, oil from the first horizontal channel 412 cannot flow to the supply channel 910, splash out of the rocker arm, and then drip back to lubricate the first valve lift mechanism 922 and first pushrod system 924. In one example, oil flow from the cylinder head to the first horizontal channel 412 during the first condition may be reduced and the oil flowing through the first horizontal channel 412 may be routed through the draining oil channels such as the first passage 414, a second passage 416, and a third passage 418 to a bottom of rocker shaft/rocker bore to lubricate the bush bearing and the rocker shaft enclosed within the bush bearing and thereby facilitate the oscillating motion of the rocker arm. By inhibiting oil flow to the intake valve lift mechanism and the pushrod during a closed state of the valve flooding of the valve stem seal may be reduced. Further, by supplying oil to the mechanical parts of the rocker shaft via the draining oil channels, friction between adjacent metallic surfaces may be reduced, thereby reducing wear of interface.

During a second condition for the intake valve, as shown in FIG. 9B, the intake valve at the end of the first valve lift mechanism 922 coupled to the first end (tip) of the third rocker arm 905 is opened. A cam lobe rotates on a camshaft causing the first end to press down on the valve stem of the valve lift mechanism 922, thereby opening the intake valve. In this condition, the second vertical oil channel 504 and supply channel 910 are aligned, thereby fluidically connecting the first horizontal channel 412 with the supply channel 910. Due to the alignment of the second, vertical oil channel 504 and supply channel 910, oil from the first horizontal channel 412 may flow to the opening at the end of the supply channel 910 and splash out of the supply channel 910. A first jet 952 of oil ejecting out of the supply channel 910 may impinge on the surface 932 of the cover 925. Upon alignment of the supply channel 910 and the vertical oil channel 504, the opening at the end of the supply channel 910 may face a first segment 972 of the surface 932 on a first side of the I-I' axis proximal to the valve lift mechanism 922.

The slope on the surface 932 allows the oil to flow towards the first protrusion 926 positioned vertically above the valve lift mechanism 922 and the third protrusion 928 positioned vertically above the lash adjuster of the pushrod system 924. The oil flowing to the base of the first protrusion 926 may then trickle down the tip of the first protrusion 926 and a second jet 954 may drip on the valve lift mechanism 922. Also, a portion of oil flowing to the base of the third protrusion 928 may then trickle down the tip of the third protrusion 928 and a third jet 956 may drip on the pushrod system 924. Due to the offset (relative to the I-I' axis) alignment of the supply channel 910, a higher volume of oil may flow towards the first protrusion 926 relative to the third protrusion 928. Also, due to the first protrusion 926 being bigger in size relative to the third protrusion 928, the second jet 954 may include a higher oil flow relative to the third jet 956 ensuring desired lubrication of the first valve lift mechanism 922.

In one example, oil flow from the cylinder head to the first horizontal channel 412 during the second condition may be increased. A first portion the oil flowing through the first horizontal channel 412 may be routed to the first valve lift mechanism 922 of the intake valve via the supply channel 910 while a second portion of the oil may be routed to the draining oil channels such as the first passage 414, a second passage 416, and a third passage 418 to lubricate the bush bearing and the rocker shaft enclosed within the bush bearing.

During a first condition for the exhaust valve, as shown in FIG. 9C, the exhaust valve at the end of the second valve lift mechanism 923 coupled to the first end of the fourth rocker arm 907 is closed. In this condition, there is an offset between the second, vertical oil channel 504 and supply channel 910, thereby disconnecting the first horizontal channel 412 from the supply channel 910. Due to the offset between the second, vertical oil channel 504 and supply channel 910, oil from the first horizontal channel 412 cannot flow to the supply channel 910, splash out of the rocker arm, and then drip back to lubricate the second valve lift mechanism 923 and second pushrod system 927. In one example, oil flow from the cylinder head to the first horizontal channel 412 during the first condition may be reduced and the oil flowing through the first horizontal channel 412 may be routed through the draining oil channels such as the fourth passage 424, a fifth passage 426, and a sixth passage 428 to a bottom of rocker shaft/rocker bore to lubricate the bush bearing and the rocker shaft enclosed within the bush bearing and thereby facilitate the oscillating motion of the rocker arm. By inhibiting oil flow to the exhaust valve lift mechanism and the pushrod during a closed state of the valve flooding of the valve stem seal may be reduced. Further, by supplying oil to the mechanical parts of the rocker shaft via the draining oil channels, friction between adjacent metallic surfaces may be reduced, thereby reducing wear of interface.

During a second condition for the exhaust valve, as shown in FIG. 9D, the exhaust valve at the end of the second valve lift mechanism 923 coupled to the first end (tip) of the fourth rocker arm 907 is opened. A cam lobe rotates on a camshaft causing the first end to press down on the valve stem of the valve lift mechanism 922, thereby opening the exhaust valve. In this condition, the second vertical oil channel 504 and supply channel 910 are aligned, thereby fluidically connecting the first horizontal channel 412 with the supply channel 910. Due to the alignment of the second, vertical oil channel 504 and supply channel 910, oil from the first horizontal channel 412 may flow to the opening at the end of the supply channel 910 and splash out of the supply channel 910. A first jet 982 of oil ejecting out of the supply channel 910 may impinge on the surface 932 of the cover 925.

The slope on the surface 932 allows the oil to flow towards the second protrusion 966 positioned vertically above the second valve lift mechanism 923 and the fourth protrusion 968 positioned vertically above the lash adjuster of the second pushrod system 927. The oil flowing to the base of the second protrusion 966 may then trickle down the tip of the second protrusion 966 and a second jet 984 may drip on the second valve lift mechanism 923. Also, a portion of oil flowing to the base of the fourth protrusion 968 may then trickle down the tip of the fourth protrusion 968 and a third jet 986 may drip on the pushrod system 927. Due to the second protrusion 966 being bigger in size relative to the fourth protrusion 968, the second jet 984 may include a higher oil flow relative to the third jet 986 ensuring desired lubrication of the second valve lift mechanism 923.

In one example, oil flow from the cylinder head to the first horizontal channel 412 during the second condition may be increased. A first portion the oil flowing through the first horizontal channel 412 may be routed to the second valve lift mechanism 923 of the exhaust valve via the supply channel 910 while a second portion of the oil may be routed to the draining oil channels such as the first passage 414, a second passage 416, and a third passage 418 to lubricate the bush bearing and the rocker shaft enclosed within the bush bearing. In this way, lubricating oil may be intermittently supplied to a tip of a rocker arm and a corresponding valve stem without any horizontal oil channel within the rocker arm during actuation of the valve coupled to it.

Figure 11:
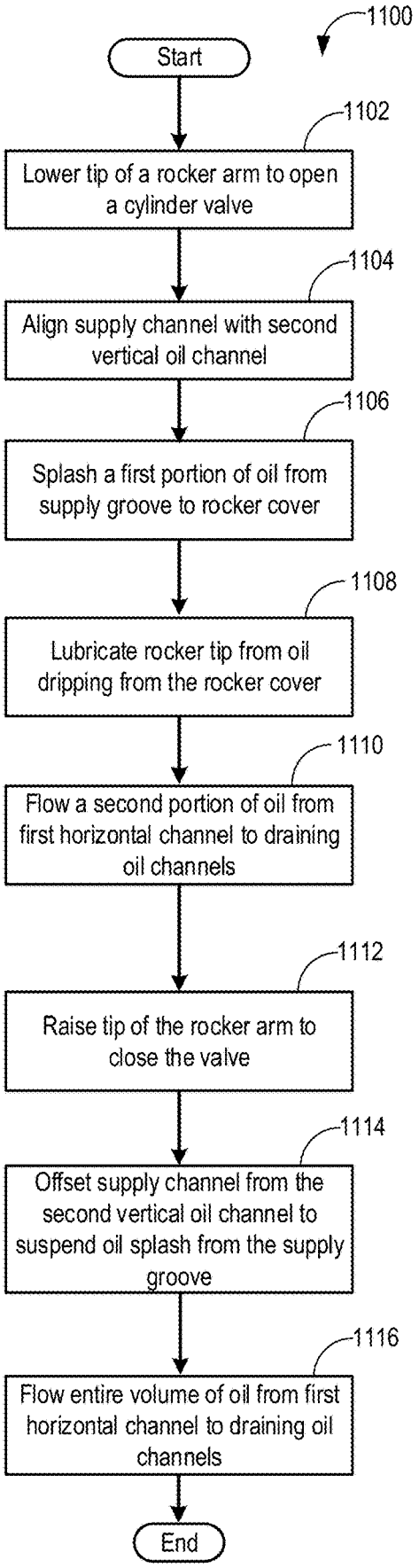
FIG. 11 shows a second flow-chart illustrating an example method for intermittently supplying lubricating oil to a tip of a rocker arm according to a second embodiment.

FIG. 11 shows a second example method 1100 for intermittently supplying lubricating oil to a tip of a rocker arm. In this example, a second embodiment of rocker arm (such as third rocker arm 905 and fourth rocker arm 907 in FIGS. 9A-9D) may not include a horizontal channel within the rocker arm but instead the rocker arm may be enclosed under a cover equipped with features such as protrusions and slopes that allow oil impinging on the cover to drip back to the rocker arm tip.

At 1102, a tip (such as a first end) of the rocker arm may be lowered to open a cylinder valve. The valve may be an intake valve or an exhaust valve. Rotation of a cam lobe on a camshaft may cause the tip of the rocker arm to press down on a valve stem of the cylinder valve, thereby opening the valve.

At 1104, as the tip of the rocker arm is lowered, a supply channel (such as supply groove 910 in FIGS. 9A-9B) may be aligned with a second vertical oil channel (such as second vertical oil channel 504 in FIGS. 9A-9B) which in turn may be coupled to a central first horizontal oil channel passing through the center of a rocker shaft of the rocker arm.

At 1106, a first portion of lubricating oil may be splashed to the cover of the rocker arms via the opening at the end of the supply channel facing the cover. The lubricating oil may be supplied to the supply channel from the central first horizontal oil channel. Upon impinging on the surface of the cover, due to the sloping nature of the surface, the oil may flow to two opposite ends.

At 1108, first rocker arm tip coupled to the valve lifting mechanism and a second rocker arm tip coupled to a pushrod may be lubricated by oil dripping from the rocker cover. The oil from the surface of the rocker cover may drip down on the rocker arms tips from protrusions on the surface directly facing the rocker arm tips. The lubricating oil may drip on the valve lifting mechanism and the pushrod from the pointed ends of the protrusions. In this way topological features on the rocker arm surface may be used to guide lubricating oil sprayed on the cover to drip and lubricate valve actuation mechanism and pushrod coupled to a rocker arm.

At 1110, a second portion of the lubricating oil may flow from the central first horizontal oil channel to one or more draining oil channels leading to a lower portion of the rocker shaft/rocker bore such as to a bearing around the rocker shaft to facilitate movement of the rocker arm about the bearing. By supplying oil to the lower part of the rocker shaft via the draining oil channels, friction between adjacent metallic surfaces may be reduced, thereby reducing wear of interfaces. In one example, the first portion of oil supplied to the tip of the rocker arm may be higher than the second portion of oil routed to the draining oil channels.

At 1112, the tip of the rocker arm may be raised to close the valve. Rotation of the cam lobe on the camshaft may cause the tip of the rocker arm to be raised, causing a return spring coupled to the valve stem to close the valve. Due to the change in inclination of the rocker arm, at 1114, the supply channel may become offset from the second vertical oil channel and splashing of oil onto the rocker arm cover form the supply channel may be suspended. Therefore, upon closure of a cylinder valve, oil may no longer be supplied to the tip of the rocker arm coupled to that valve.

At 1116, entire volume of oil may flow from the central first horizontal oil channel to the one or more draining oil channels leading to the bearing around the rocker shaft facilitating movement of the rocker arm about the bearing.

In this way, upon aligning of oil channels only during opening of a valve coupled to a tip of a rocker arm, lubricating oil may be selectively splashed to a cover of the rocker arm and then the splashed lubricating oil may be supplied to the tip of the rocker arm via topographical features on the surface of the cover facing the rocker arm.

FIGS. 3-6D and 9A-9D show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

As used herein, an element or step recited in the singular and proceeded with the word "a" or "an" should be understood as not excluding plural of said elements or steps, unless such exclusion is explicitly stated. References to "one embodiment" or "one example" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property. The terms "including" and "in which" are used as the plain-language equivalents of the respective terms "comprising" and "wherein." Moreover, the terms "first," "second," and "third," etc., are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A method for an engine, the method comprising:

during a first condition, supplying lubricating oil to a rocker arm, including a first tip of the rocker arm that is coupled to a valve and a lash adjuster end of the rocker arm opposite the first tip, via protrusions housed on a surface of a cover of the rocker arm that differ in size by splashing out the lubricating oil from a supply channel aligned with a first channel carrying the lubricating oil onto the protrusions, where the protrusions include a protrusion positioned above the first tip of the rocker arm and a further protrusion positioned above the lash adjuster end of the rocker arm opposite the first tip, and where more of the lubricating oil is supplied to the first tip of the rocker arm via the protrusion than to the lash adjuster end of the rocker arm via the further protrusion; and during a second condition, suspending supply of the lubricating oil to the first tip by offsetting the supply channel from the first channel.

2. The method of claim 1, wherein the lubricating oil is supplied from the supply channel to the cover, and wherein a ridge is formed into the cover.

3. The method of claim 2, wherein supplying the lubricating oil by splashing out the lubricating oil includes guiding the lubricating oil along a slope on the surface, and dripping the lubricating oil over the tip of the rocker arm via the protrusions on the surface.

4. The method of claim 1, wherein the first channel carries the lubricating oil from a cylinder head to the supply channel through one or more of a pillar of a rocker pedestal and a rocker shaft passing through a pivot point of the rocker arm, the rocker arm oscillating about the pivot point.

5. The method of claim 1, further comprising, during each of the first condition and the second condition, flowing at least a portion of the lubricating oil from the first channel to a set of draining channels leading to a bearing configured to oscillate the rocker arm.

6. A system for an engine, the system comprising:

a first channel fluidically coupled to an oil sump at a first end, wherein the oil sump is at a cylinder head;

a supply groove selectively aligned with the first channel based on an angle of a rocker arm; and a cover of the rocker arm including a first sloping surface section and a second sloping surface section, wherein multiple protrusions are included on the first sloping surface section and the second sloping surface section, the multiple protrusions including a first protrusion pointing to a first end of the rocker arm on the first sloping surface section, the first end of the rocker arm coupled to a valve, and a second protrusion pointing to a second end of the rocker arm that is a lash adjuster end on the second sloping surface section, wherein the first protrusion and the second protrusion differ in size, the second protrusion being smaller in size than the first protrusion, and wherein the first protrusion and the second protrusion are configured to provide more lubricating oil to the first end of the rocker arm than to the second end of the rocker arm.

7. The system of claim 6, wherein selectively aligned includes the supply groove being aligned with the first channel upon the first end of the rocker arm being lowered during opening of the valve, and the supply groove being offset with the first channel upon the first end of the rocker arm being raised upon closing of the valve.

8. The system of claim 6, wherein, upon the supply groove being aligned with the first channel, lubricating oil from the first channel is splashed onto the cover via an opening at an end of the supply groove facing the cover.

9. The system of claim 6, wherein the cover includes a ridge with the first sloping surface section on a first side of the ridge and the second sloping surface section on a second side of the ridge, each of the first sloping surface section and the second sloping surface section sloping downward away from the ridge separating the first sloping surface section from the second sloping surface section.

* * * * *